US006673527B2

(12) United States Patent
Yamashita

(10) Patent No.: US 6,673,527 B2
(45) Date of Patent: Jan. 6, 2004

(54) COLOR DEVELOPER SOLUTION, CONCENTRATED COMPOSITION THEREOF FOR USE IN SILVER HALIDE COLOR PHOTOGRAPHIC MATERIAL AND PROCESSING METHOD

(75) Inventor: Hiroshi Yamashita, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/207,455

(22) Filed: Jul. 29, 2002

(65) Prior Publication Data

US 2003/0143497 A1 Jul. 31, 2003

(30) Foreign Application Priority Data

Aug. 8, 2001 (JP) ..... 2001-240094

(51) Int. Cl.[7] ..... G03C 7/413
(52) U.S. Cl. ..... 430/490
(58) Field of Search ..... 430/490

(56) References Cited

U.S. PATENT DOCUMENTS 5,391,467 A * 2/1995 Yoshida et al. ..... 430/434
5,827,635 A * 10/1998 Cole ..... 430/372
5,837,435 A * 11/1998 Abe ..... 430/490
6,017,687 A 1/2000 Darmon et al.
6,220,925 B1 * 4/2001 Saito et al. ..... 430/546

FOREIGN PATENT DOCUMENTS

| | | |
|---|---|---|
| EP | 0 343 557 A2 | 11/1989 |
| EP | 0 426 062 A1 | 5/1991 |
| EP | 0 556 716 A2 | 8/1993 |
| JP | 3-184044 A | 8/1991 |

* cited by examiner

*Primary Examiner*—Hoa Van Le
(74) *Attorney, Agent, or Firm*—Frishauf, Holtz, Goodman & Chick, P.C.

(57) ABSTRACT

A color developer solution capable of inhibiting precipitation or tar-staining occurring in the processing tank or the roller rack, even when being processed rapidly or at low replenishing rate and a concentrated composition thereof is disclosed, comprising at least one selected from specified N-disubstituted hydroxylamine derivatives and at least one selected from specified N-monosubstituted hydroxylamine derivatives in a molar ratio falling within the range of 1000:1 to 1:1.

13 Claims, No Drawings

COLOR DEVELOPER SOLUTION, CONCENTRATED COMPOSITION THEREOF FOR USE IN SILVER HALIDE COLOR PHOTOGRAPHIC MATERIAL AND PROCESSING METHOD

FIELD OF THE INVENTION

The present invention relates to a color developer solution and its concentrated composition for use in silver halide color photographic materials, a processing method by the use thereof, and in particular to a color developer solution for use in silver halide color photographic materials, which is capable of inhibiting precipitation or tar-staining caused in a processing tank or a roller rack, even when being processed rapidly or at a low replenishing rate, a concentratedeveloper composition forming no deposits even when dissolved in a relatively high concentration, and a processing method by the use thereof.

BACKGROUND OF THE INVENTION

In general, to form color images by processing a silver halide color photographic material, the photographic material is imagewise exposed and developed with a color developer solution containing a p-phenylenediamine type color developing agent, wherein silver halide is reduced to silver and the color developing agent is concurrently oxidized to form an oxidation product, which is coupled with a coupler contained in the photographic material to form an imagewise dye corresponding to the developed silver.

Processing photographic material results in accumulation of development inhibiting material leached out of the processed photographic material in the color developer solution, while a developing agent is consumed and its concentration in the developer solution decreases. Accordingly, when using an automatic processor to continuously process a large amount of silver halide photographic material, a means for maintaining constituents of the developer solution within a prescribed concentration range is essential to avoid fluctuation in development finishing characteristics. As such a means usually adapted is a replenishing method to replenish decreasing components and to dilute unwanted increasing components.

As described above, the color developing agent is contained in the color developer solution and reacts with a coupler contained in the photographic material to form a dye, while the developing agent is oxidized by ambient oxygen, so that an antioxidant, called a preserver is usually added into the color developing solution. Hydroxylamine salts have been known as a preserver for color developing solutions. For example, JP-A No. 1-298351 (hereinafter, the term, JP-A refers to Japanese Patent Application Publication) discloses mono- and di-substituted hydroxylamine derivatives, some of which has been used in practice.

Recently, reduction of the replenishing rate is being desired for the purpose of shortening a processing time and/or environmental protection. To achieve this, it is necessary to enhance the concentration of a color developing agent or raise the processing temperature. However, when the color developing agent is dissolved in a relative high concentration or the processing temperature is set at a relatively high value, crystalline precipitates or tar-like deposits are produced at the interface of the processing solution and the walls of the processing tank or the rack which transport the photographic material, resulting in problems such as staining or adverse effects to the photographic material.

To compensate for components consumed along with processing of the photographic material, in general, a replenisher solution is supplied to the processing tank in accordance with the area of the processed photographic material. The replenisher solution, usually, is commercially available in the form of a concentrated composition and is generally referred to as a kit or a concentrated solution kit (concentrated composition), to which users add a prescribed amount of water prior to use to prepare a processing solution. Specifically, a concentrated color developer solution kit (concentrated composition) has been supplied in the form of plural parts, in which reactive component are separated from each other for storage over a long period of time. For storage stability, the color developing agent is usually dissolved in a part solution having a relatively low pH. Further, to prevent user's errors in preparation of the developer solution or to mitigate a dissolution work, it has been attempted to reduce the number of parts and a concentrated color developer solution kit in a single part form is commercially available.

In the single part concentrated solution kit, a color developing agent is required to be dissolved in a solution having a relatively high pH. Specifically, to achieve replenishment at a relatively low rate, it is necessary to set both, the pH and the color developing agent concentration at relatively high values, so that the pH and concentration of the kit have to be necessarily raised. However, a kit having a relatively high pH and relatively high concentration of a color developing agent easily forms precipitates during storage at low temperatures, making it difficult to enhance the concentration factor and produces problems as the kit volume becomes greater.

SUMMARY OF THE INVENTION

Accordingly, it is a first object of the present invention to provide a color developer solution for use in silver halide color photographic materials, which is capable of inhibiting precipitation or tar-staining occurring in the processing tank or the roller rack, even when being processed rapidly or at a low replenishing rate, its concentrated composition and a processing method by the use thereof.

It is a second object of the invention to provide a concentrated developer composition forming no deposit even when dissolved at a relatively high concentration.

The foregoing objects of the invention can be accomplished by the following constituent:

1. A color developer solution for use in silver halide color photographic materials containing at least one selected from compounds represented by the following formula (1) and at least one selected from compounds represented by the following formula (2) at a molar ratio of 1000:1 to 1:1, $$HO—N—(X—A)_2 \qquad \text{formula (1)}$$

wherein X is a substituted or unsubstituted alkylene group; A is a carboxyl group, sulfo group, phosphono group, hydroxy group, alkoxy group, amino group, ammonio group, sulfamoyl group, or alkylsulfonyl group, which may be in a salt form;

$$HO—NH—Y—B \qquad \text{formula (2)}$$

wherein Y is a substituted or unsubstituted alkylene group; B is a carboxyl group, sulfo group, phosphono group, hydroxy group, alkoxy group, amino group, ammonio group, sulfamoyl group, or alkylsulfonyl group, which may be in a salt form, provided that X and Y, or A and B may the same or different;

2. The color developer solution as described in 1., wherein a molar ratio of the compound represented by formula (1) to the compound represented by formula (2) is 100:1 to 10:1;

3. The color developer solution as described in 1. or 2., wherein the color developer solution contains 0.02 to 0.04 mol/l of a p-phenylenediamine type color developing agent;

4. The color developer solution as described in any of above 1. through 3., wherein the color developer solution contains a compound represented by the following formula (3):

$$HO—(R—O)_n—H \qquad \text{formula (3)}$$

wherein R is $—CH_2CH_2—$, $—CH_2CH_2CH_2—$ or $CH_2CH(CH_3)—$; and n is an integer of 1 through 30;

5. The color developer solution as described in 4., wherein the color developer solution contains 10 to 100 g/l of the compound represented by formula (4);

6. A concentrated color developer composition for use in silver halide color photographic materials containing at least one selected from compounds represented by the foregoing formula (1) and at least one selected from compounds represented by the foregoing formula (2) in a molar ratio of 1000:1 to 1:1, and further comprising a p-phenylenediamine type color developing agent;

7. The concentrated color developer composition as described in 6., wherein a molar ratio of the compound represented by formula (1) to the compound represented by formula (2) is 100:1 to 10:1;

8. The concentrated color developer composition as described in 6. or 7., wherein the concentrated color developer composition contains a compound represented by the foregoing formula (3);

9. The concentrated color developer composition as described in 8., wherein the compound represented by formula (3) is contained in an amount of 50 to 700 g/l;

10. The concentrated color developer composition as described in any of 6. through 9., wherein the concentrated color developer composition has a pH of 11 to 14;

11. A method for processing a silver halide color photographic material by the use of a color developer solution as described in any of 1. through 5., and a replenishing rate of the color developer solution being 20 to 100 ml per $m^2$ of the photographic material.

Hereinafter, the expression, color developer solution is used to refer to a color developer solution as a processing solution, a developer replenishing solution or a concentrated color developer composition as a concentrated.

EMBODIMENTS OF THE INVENTION

In the color developer solution or the concentrated color developer composition according to the invention, a molar ratio of the compound represented by formula (1) to the compound represented by formula (2) is between 1000:1 and 1:1 and preferably between 100:1 and 10:1. In other words, the molar ratio of the compound represented by formula (1) to the compound represented by formula (2) is 1 to 1000 moles and preferably 10 to 100 moles of the compound (1) per mole of the compound (2). In the formulas (1) and (2), X and Y are independently an alkylene group, which may be substituted, and the alkylene group being preferably methylene, ethylene, propylene and iso-propylene; A and B are independently a carboxyl group, sulfo group, phosphono group, hydroxyl group, alkoxy group, amino group, ammonio group, sulfamoyl group, or alkylsulfonyl group, these groups may be in the form of a salt, such as alkali metal salt.

Exemplary examples of the compound represented by the foregoing formula (1) are shown below, but the invention will be by no means limited to these.

1-1

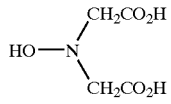

1-2

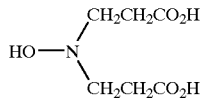

1-3

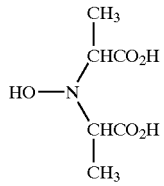

1-4

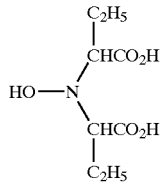

1-5

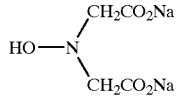

1-6

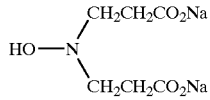

1-7

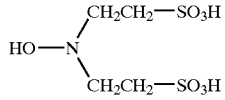

1-8

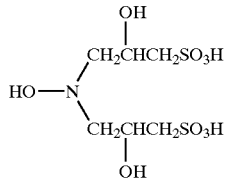

1-9

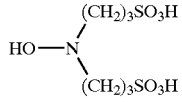

1-10

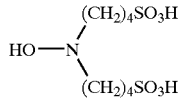

1-11

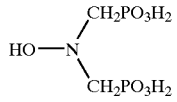

-continued 1-12

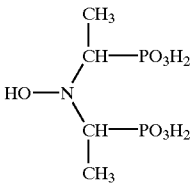

1-13

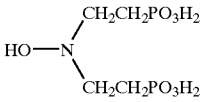

1-14

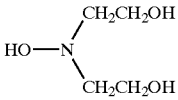

1-15

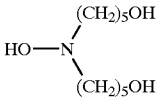

1-16

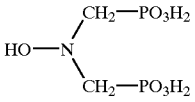

1-17

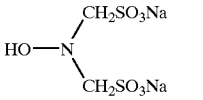

1-18

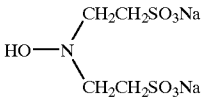

1-19

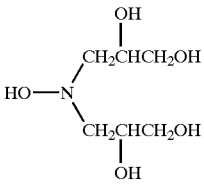

1-20

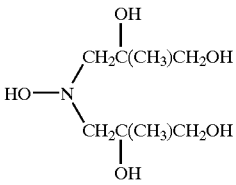

The content of the compound represented by formula (1) is preferably 0.005 to 0.05 mol per liter of color developer solution or 0.01 to 0.5 mol per liter of concentrated color developer composition.

Exemplary examples of the compound represented by the foregoing formula (2) are shown below, but the invention will be by no means limited to these.

2-1

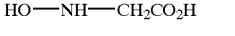

2-2

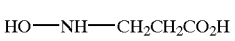

-continued 2-3

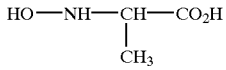

2-4

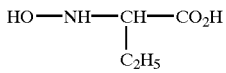

2-5

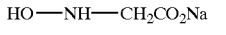

2-6

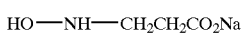

2-7

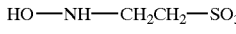

2-8

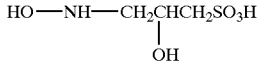

2-9

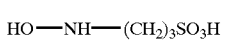

2-10

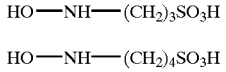

2-11

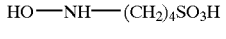

2-12

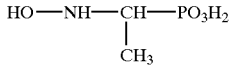

2-13

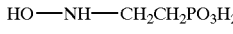

2-14

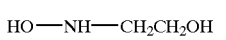

2-15

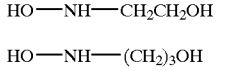

2-16

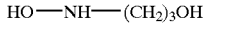

2-17

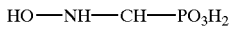

2-18

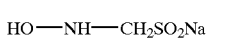

2-19

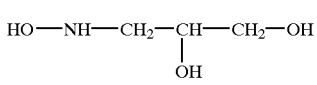

2-20

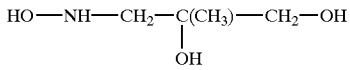

Color developing agents used in the invention are paraphenylenediamine-type color developing agents, which are commonly known in the photographic art and are selected from derivatives of paraphenylenediamine (hereinafter, also denoted as p-phenylenediamine), i.e., p-phenylenediamine compounds.

The p-phenylenediamine-type color developing agent is represented by the following general formula:

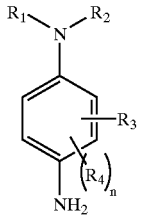

wherein $R_1$, $R_2$, $R_3$ and $R_4$ each are independently a hydrogen atom, halogen atom, carboxyl group, sulfo group, sulfamoyl group, alkylsulfonyl group, or an alkyl, alkoxy or aryl group, which may be substituted, provided that $R_2$ and $R_3$, or $R_3$ and $R_4$ may combine with each other to form a ring; n is an integer of 0 to 3.

The p-phenylenediamine-type color developing agents used in the invention preferably are a p-phenylenediamine compound having a water-solubilizing group (i.e., group promoting solubility in water) to achieve effects of the invention. Thus, the p-phenylenediamine compound having a water-solubilizing group exhibits advantages such as causing no stain in photographic material and no skin irritation, as compared to p-phenylenediamine type compound having no water-solubilizing group, such as N,N-diethyl-p-phenylenediamine. The water-solubilizing group is substituted onto an amino group or on a benzene nucleus of the p-phenylenediamine compound. Preferred examples of the water-solubilizing group include $—(CH_2)_n—CH_2OH$, $—(CH_2)_m—NHSO_2—(CH_2)_n—CH_3$, $—(CH_2)_m—O—(CH_2)_n—CH_3$, $—(CH_2CH_2O)_n—C_mH_{2m+1}$, —COOH and $—SO_3H$, in which m and n are each an integer of 0 or more.

Preferred examples of the p-phenylenediamine type color developing agents used in the invention are shown below.

(1)

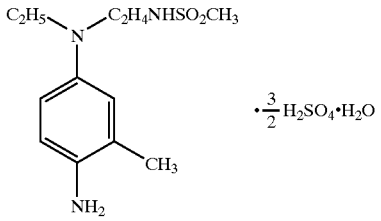

(2)

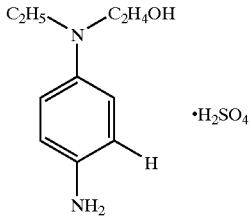

(3)

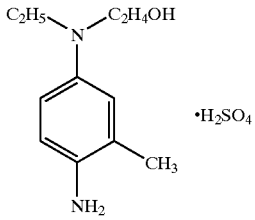

(4)

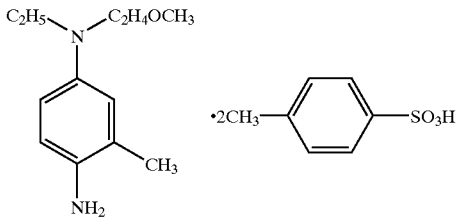

(5)

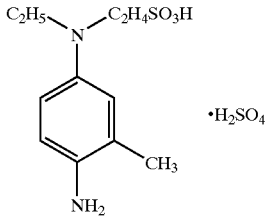

-continued (6)

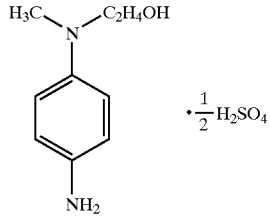

(7)

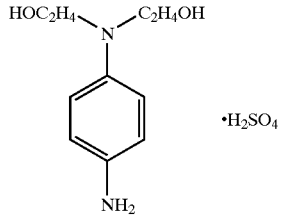

(8)

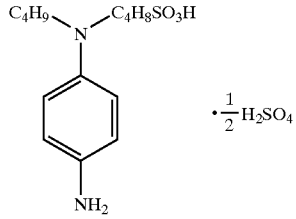

(9)

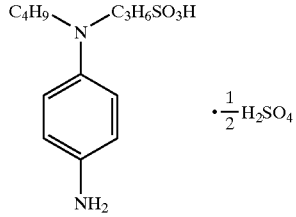

(10)

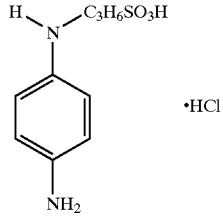

(11)

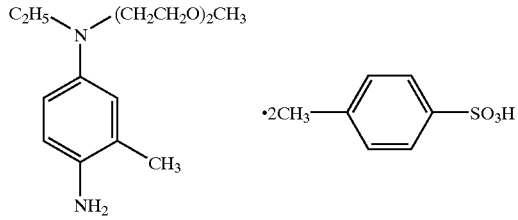

(12)

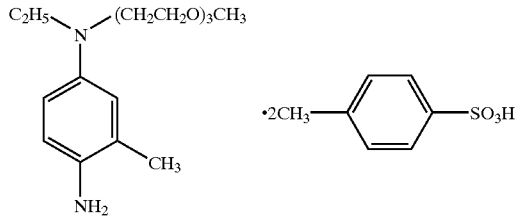

-continued (13)

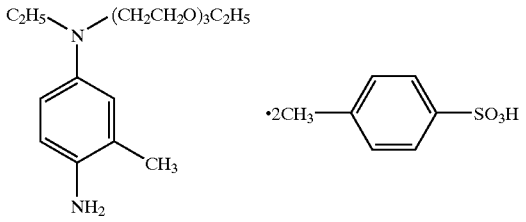

(14)

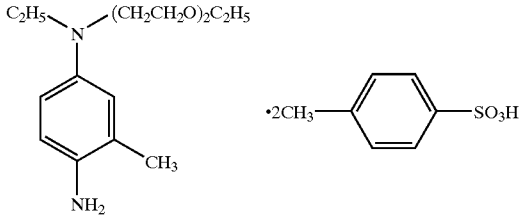

(15)

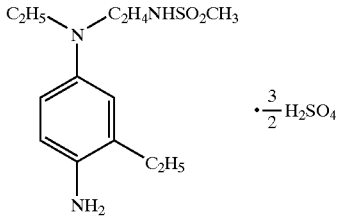

(16)

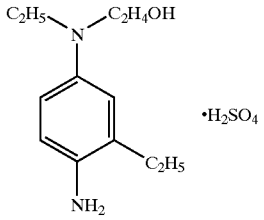

(17)

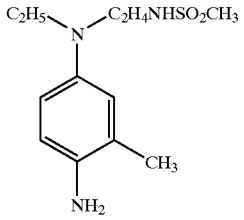

-continued (18)

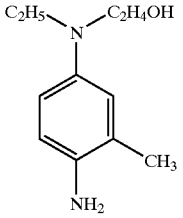

The color developing agents described above may be used in the form of other salts such as hydrochloride, sulfate and p-toluenesulfonate. The color developing agent is used preferably in amount of $2\times10^{-3}$ to $2\times10^{-1}$ mol, and more preferably $2\times10^{-2}$ to $4\times10^{-2}$ mol per liter of a color developer solution.

Exemplary examples of the compound represented by formula (3) are shown below but are not limited to these.

Ethylene glycol

Diethylene glycol

Triethylene glycol

Tetraethylene glycol

Propylene glycol

Dipropylene glycol

Tripropylene glycol

Polyethylene glycol #200 (av. MW 200)

Polyethylene glycol #300 (av. MW 300)

Polyethylene glycol #400 (av. MW 400)

Polyethylene glycol #600 (av. MW 600)

Polyethylene glycol #1000(av. MW 1000)

Polypropylene glycol (av. MW 400)

Polypropylene glycol (av. MW 700)

Next, when added to the color developer solution relating to the invention, compounds exhibiting remarkable effects of the invention will be described.

In the invention, it is preferred to add a triazylstibene type brightener to the color developer solution in terms of prevention of tarring. Such a triazylstilbene type brightener preferably is a compound represented by the following formula (A):

formula (A)

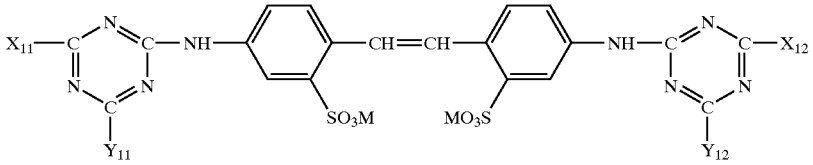

wherein $X_{11}$, $X_{12}$, $Y_{11}$, and $Y_{12}$ are independently hydroxy, a halogen atom such as chlorine or bromine, a morpholino group, an alkoxy group (e.g., methoxy, ethoxy, methoxyethoxy), an aryloxy group, (e.g., phenoxy, p-sulfophenoxy), an alkyl group (methyl, ethyl), an aryl group (e.g., phenyl, methoxyphenyl), an amino group, an alkylamino group [e.g., methylamino, ethylamino, propylamino, dimethylamino, cyclohexylamino, β-hydroxyethylamino, di(β-hydroxyethyl)amino, β-sulfoethylamino, N-(β-sulfoethyl)-N-methylamino, N-(β-hydroxyethyl)-N-methylamino], or an arylamino group (e.g., anilino, o-, m- or p-sulfoanilino, o-, m- or p-chloroanilino, o-, m- or p-toluidino, o-, m- or p-carboxyanilino, o-, m- or p-hydroxyanilino, sulfonaphthylamino, o-, m- or p-aminoanilino, o-, m- or p-anilino); M is a hydrogen, sodium, potassium, ammonium or lithium.

Examples of the compound represented by formula (A) are shown below.

(1)

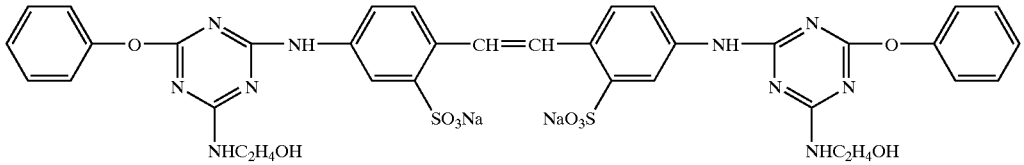

(2)

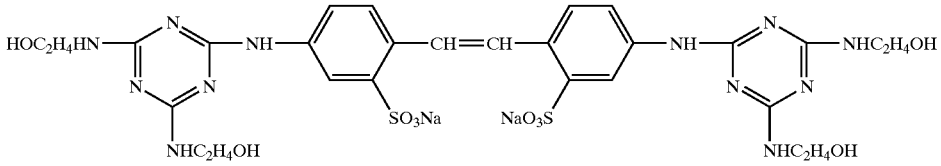

(3)

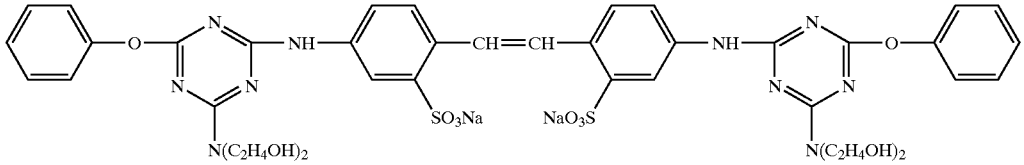

(4)

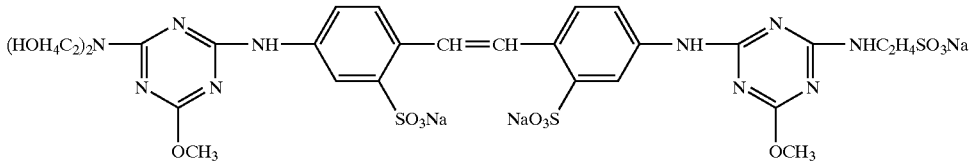

(5)

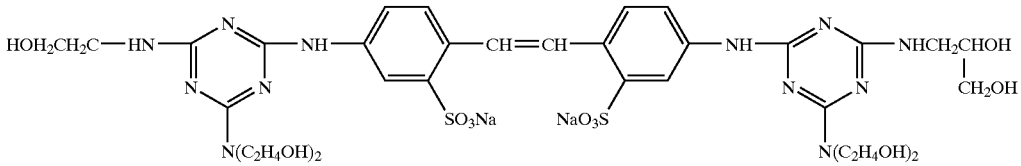

(6)

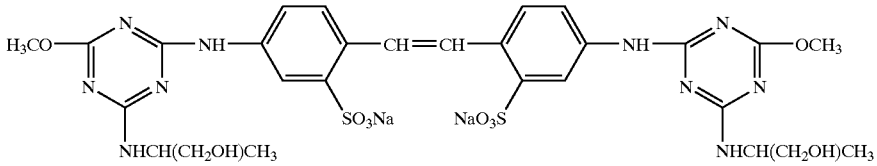

(7)

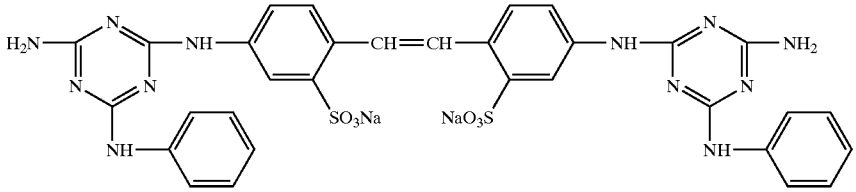

-continued (8)

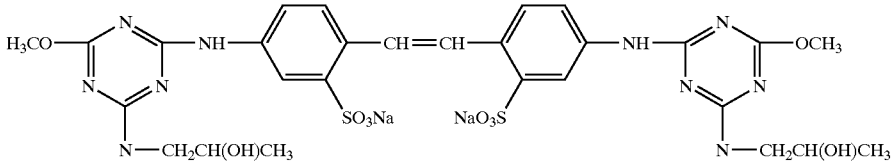

(9)

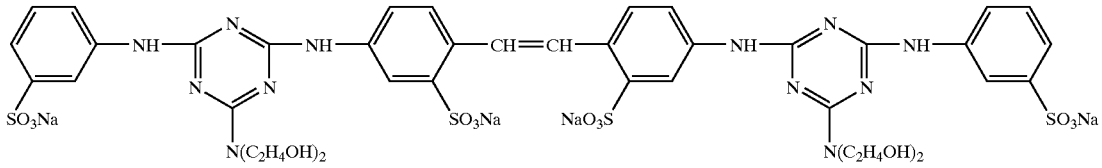

(10)

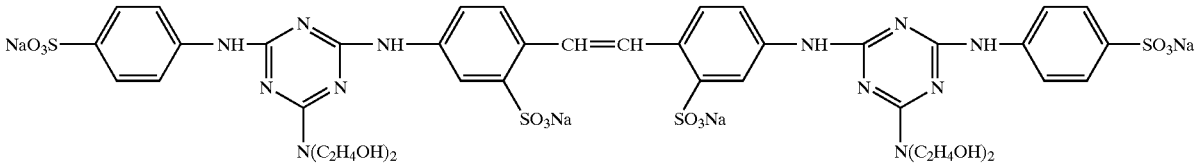

(11)

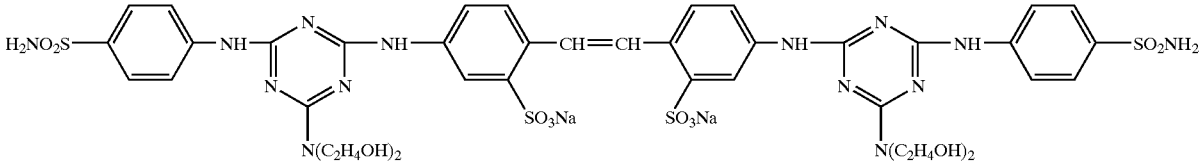

(12)

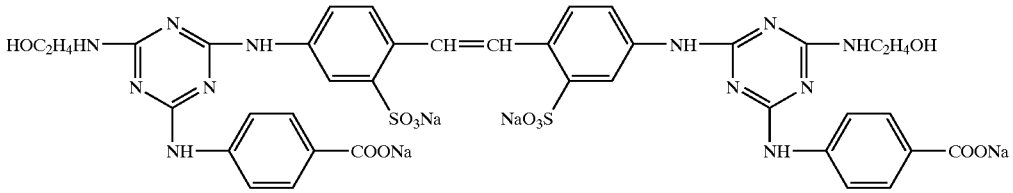

(13)

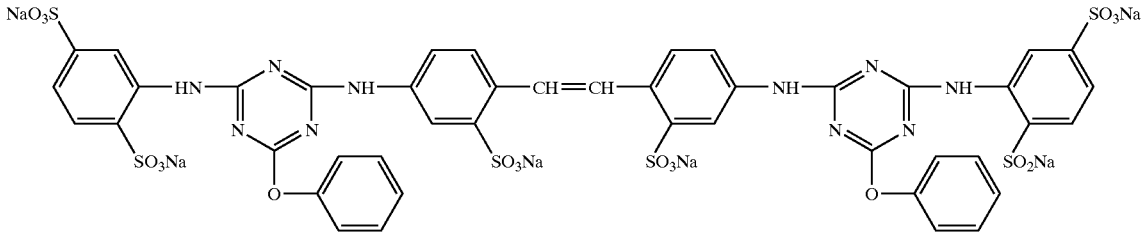

(14)

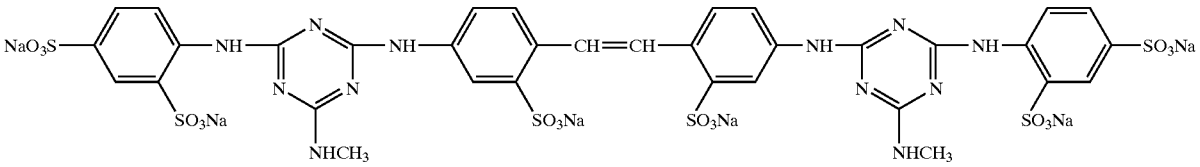

The foregoing triazylstilbene type brighteners can be readily synthesized in accordance with the conventional method, for example, as described in "Fluorescent Brightener" (edited by Kaseihin Kogyo Kyokai, published in August, 1976) page 8. The triazylstilbene type brightener is used preferably in an amount of 0.2 to 20 g per liter of a color developer solution, and more preferably 0.4 to 10 g per liter of color developer solution.

Incorporation of a chelating agent into the color developer solution relating to the invention prevents deterioration of the color developer solution, due to contamination of heavy metal ions, thereby enhancing preservability. Specifically, among the following formulas (B) through (H), chelating agents represented by formulas (E) through (H) are preferably in terms of restraining precipitation with Ca or Mg ions contained in the color developer solution:

formula (B)

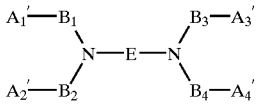

wherein E is an alkylene group, cycloalkylene group, phenylene group, —$B_5$—O—$B_5$—, —$B_5$—O—$B_5$—O—$B_5$—, or —$B_5$—Z—$B_5$—, in which Z is represented by the following formula:

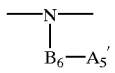

and $B_1$, $B_2$, $B_3$, $B_4$, $B_5$ and $B_6$ are each an alkylene group; $A_1'$, $A_2'$ and $A_3'$ are each —COOM' or —$PO_3(M')_2$, and $A_4'$ and $A_5'$ are each a hydrogen atom, hydroxy, —COOM' or —$PO_3(M')_2$, in which M' is a hydrogen atom or an alkali metal;

formula (C)

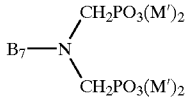

wherein $B_7$ is an alkyl group, aryl group or a 6-membered nitrogen-containing heterocyclic group; and M' is a hydrogen atom or an alkali metal atom;

formula (D)

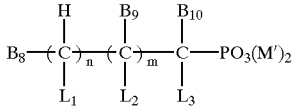

wherein $B_8$, $B_9$ and $B_{10}$ are each a hydrogen atom, hydroxy, —COOM', —$PO_3(M')_2$ or al alkyl group; $L_1$, $L_2$ and $L_3$ are each a hydrogen atom, hydroxyl, —COOM', —$PO_3(M')_2$ or —$N(J)_2$, in which J is a hydrogen atom, an alkyl group, —$C_2H_4OH$ or —$PO_3(M')_2$ and M' is a hydrogen atom or an alkali metal atom; m and n are each 0 or 1;

formula (E)

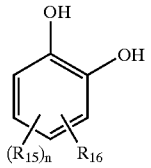

formula (F)

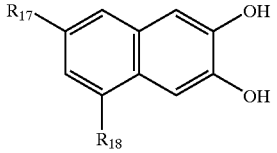

wherein $R_{15}$, $R_{16}$, $R_{17}$ and $R_{18}$ are each a hydrogen atom, a halogen atom, sulfo group, substituted or unsubstituted alkyl group having 1 to 7 carbon atoms, —$OR_{19}$, —$COOR_{20}$, —$CON(R_{21})(R_{22})$ or substituted or unsubstituted phenyl group, in which $R_{19}$, $R_{20}$, $R_{21}$ and $R_{22}$ are a hydrogen atom or an alkyl group having 1 to 18 carbon atoms; n is an integer of 1 to 3; $R_{15}$ may be the same or different;

formula (G)

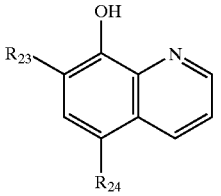

wherein $R_{23}$ and $R_{24}$ are each a hydrogen atom, a halogen atom or sulfo group;

formula (H)

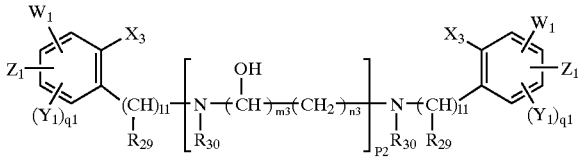

wherein $R_{29}$ and $R_{30}$ are each a hydrogen atom, a phosphoric acid group, a carboxylic acid group, —$CH_2COOH$, —$CH_2PO_3H_2$ or their salts; $X_3$ is hydroxy group or its salt; $W_1$, $Z_1$ and $Y_1$ are each a hydrogen atom, a halogen atom, hydroxy, cyano, a carboxylic acid group, a phosphoric acid group, sulfo group or their salts, an alkoxy group or an alkyl group; m3 is 0 or 1; n3 is an integer of 1 to 4; l1 is 1 or 2; p2 is an integer of 0 to 3; and q1 is an integer of 0 to 2.

Examples of chelating agents represented by formulas (B), (C) and (D) are shown below but are not limited to these.

Exemplary Chelating Agent (1)

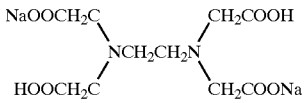

(2)

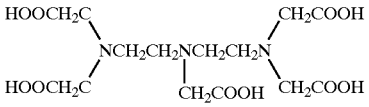

(3)

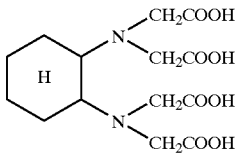

(4)

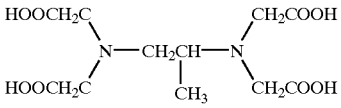

(5)

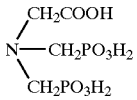

-continued
(6)
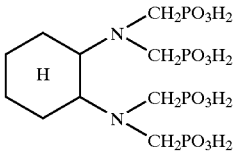
(7)
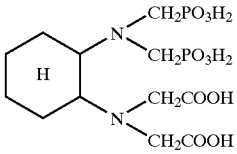
(8)
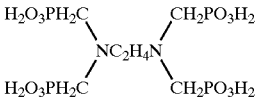
(9)
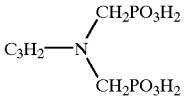
(10)
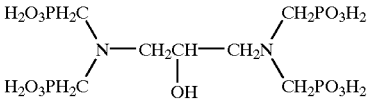
(11)
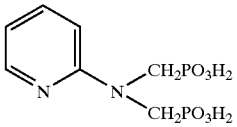
(12)
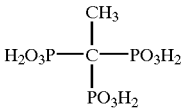
(13)
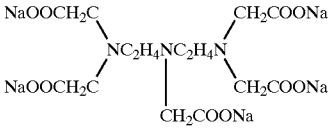
(14)
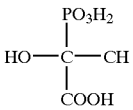
(15)
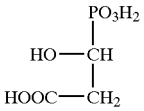
(16)
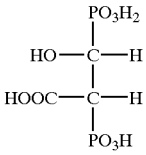
-continued
(17)
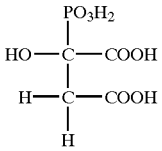
(18)
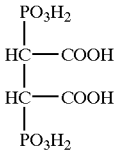
(19)
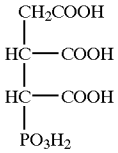
(20)
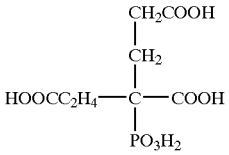
(21)
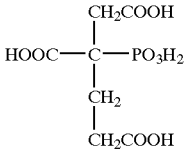
(22)
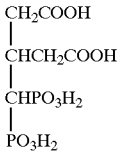
(23)
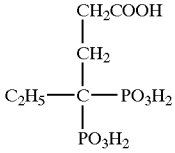
(24)
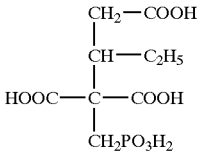
(25)
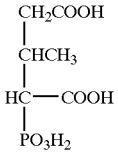

-continued
(26)
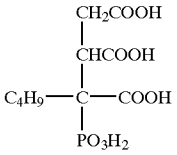
(27)
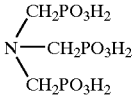
(28)
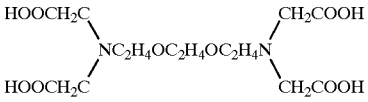
(29)
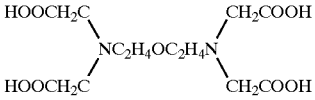
(30)
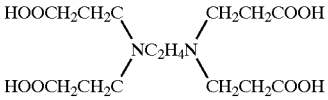
(31)
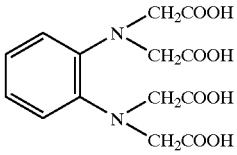
(32)
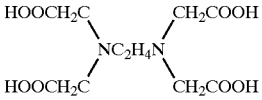
(33)
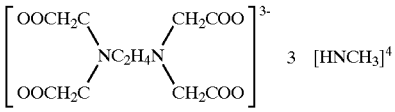
(34)
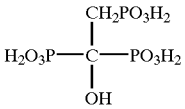
(35)
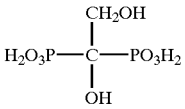
-continued
(36)
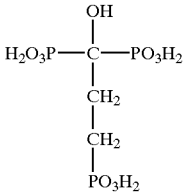
(37)
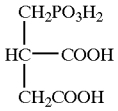
(38)
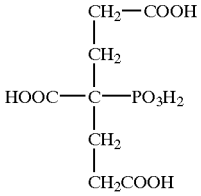
(39)
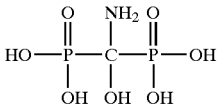
(40)
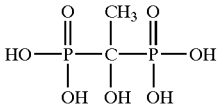
(41)
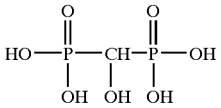
(42)
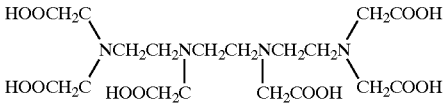
The chelating agent represented by formulas (B) to (D) is used preferably in an amount of 0.01 to 100 g, more preferably 0.05 to 50 g, and still more preferably 0.1 to 20 g per liter of color developer solution.
Examples of chelating agents represented by formulas (E) through (H) are shown below.
(43)
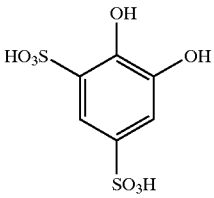
(44)
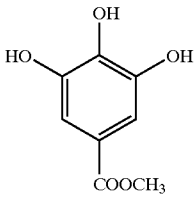

-continued
(45)
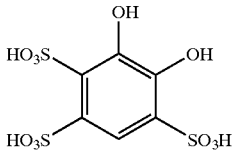
(46)
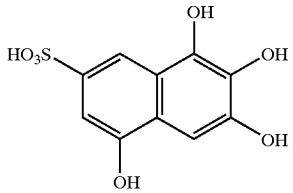
(47)
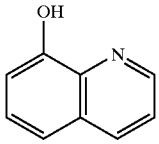
(48)
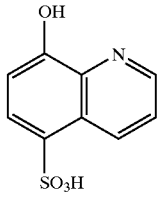
(49)
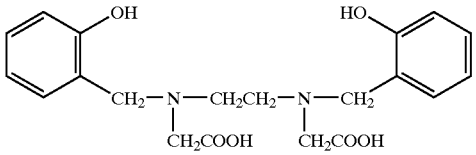
(50)
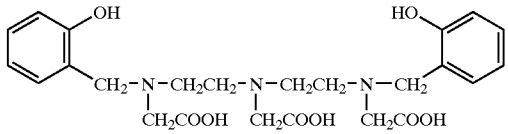
(51)
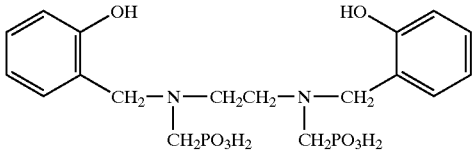
(52)
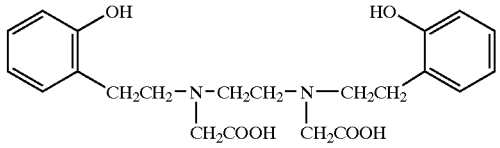
(53)
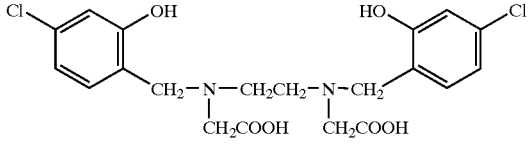
(54)
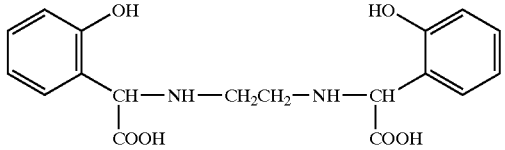
(55)
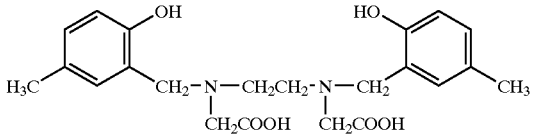
(56)
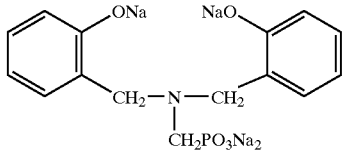
(57)
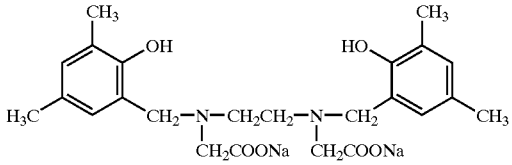
(58)
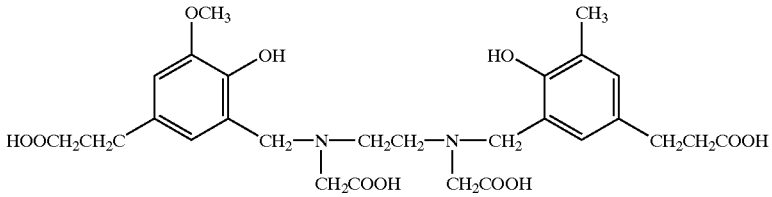

-continued (59)

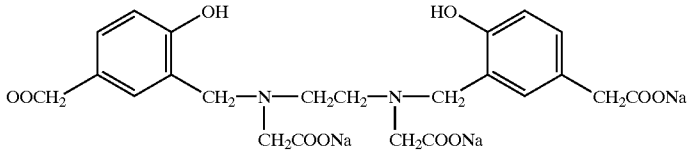

(60)

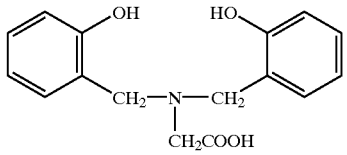

Of these chelating agents represented by formulas (E) through (H), chelating agents represented by formula (E) and (H) are preferred, and the chelating agent represented by formula (H) is more preferred. These chelating agents may be used in combination. The chelating agent represented by formulas (E) through (H) is added preferably in an amount of $1\times10^{-4}$ to 1 mol, more preferably $2\times10^{-4}$ to $1\times10^{-1}$ mol, and still more preferably $5\times10^{-4}$ to $5\times10^{-2}$ mol per liter of color developer solution. The use of these chelating agents represented by formulas (E) through (H) in the invention results in further enhanced effects of the invention; for example, precipitation shown in Example 1 was further improved to the extent of 20%.

In addition to the foregoing additives, the following compounds may be incorporated into the color developer solution.

Alkaline agents such as sodium carbonate, potassium carbonate, sodium hydroxide, potassium hydroxide, silicates, sodium metaborate, potassium metaborate, tri-sodium phosphate, tri-potassium phosphate and borates may be used alone or in combination thereof. For the purpose of necessity for preparation or enhancing an ionic strength, salts such as di-sodium hydrogen phosphate, di-potassium hydrogen phosphate, sodium bicarbonate, potassium bicarbonate and borates may be used. Inorganic or organic antifoggants may optionally be added.

Further, there may optionally be added a development accelerator. Examples thereof include pyridinium compounds described in U.S. Pat. Nos. 2,648,604 and 3,671,247 and JP-B No. 44-9503 (hereinafter, the term, JP-B refers to Japanese Patent Publication) and other cationic compounds, cationic dyes such as phenosafranine, neutral salts such as thallium nitrate, polyethylene glycol and its derivatives described in U.S. Pat. Nos. 2,533,990, 2,531,832, 2,950,970 and 2,577,127 and JP-B No. 44-9504, nonionic compounds such as polythioethers and organic solvents described in JP-B 44-9509. There are also cited benzyl alcohol, and phenethyl alcohol described in U.S. Pat. No. 2,304,925, acetylene glycol, methyl ethyl ketone, cyclohexanone, thioethers, pyridine, ammonia, hydrazine and amines. In the color developer solution of the invention, superior developability was provided without using benzyl alcohol, which are toxic for human body, so that it is preferred to contain no benzyl alcohol.

There may be used an auxiliary developer together with a developer. Examples of the auxiliary developing agent include N-methyl-p-aminophenol hexasulfate (metol), phenidone, N,N'-diethyl-p-aminophenol hydrochloride, and N,N,N',N'-tetramethyl-p-phenylenediamine. These auxiliary developer used preferably in an amount of 0.01 to 10 g/l. Further thereto, there may optionally be incorporated a competing coupler, a fogging agent, colored coupler, development inhibitor releasing type coupler (so-called DIR coupler) and a development inhibitor releasing compound. Furthermore, other additives such as anti-staining agent, anti-slugging agent and an interimage effect-promoting compound may be incorporated.

The color developer solution is preferably added with a compound (surfactant) represented by the following formula (SI) or (SII):

formula (SI)

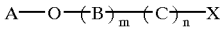

wherein A is a univalent organic group, and B and C, which may be the same or different are a group represented by the following formula:

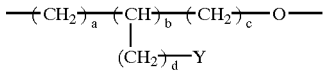

in which a, b and c are each 0, 1, 2 or 3, d is 0 or 1, and Y is a hydrogen atom or hydroxy, provided that a, b and c are not zero at the same time, m and n are each an integer of 1 to 100 and X is a hydrogen atom, an alkyl group, an aralkyl group or aryl group;

formula (SII)

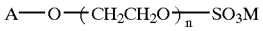

wherein M is a hydrogen atom, an alkali metal atom, an ammonium salt or an alkanolamine salt; A is a univalent organic group; n is an integer of 1 to 100.

Formulas (SI) and (SII) are further described. In formula (SI), A is a univalent organic group, including an alkyl group having 6 to 50 carbon atoms, and preferably 6 to 35 carbon atoms (e.g., hexyl, heptyl, octyl, nonyl, decyl, undecyl, dodecyl) and an aryl group substituted by an alkyl group having 1 to 35 carbon atoms or alkenyl group having 2 to 35 carbon atoms. Preferred group substituted onto the aryl group include an alkyl group having 1 to 18 carbon atoms (e.g., unsubstituted alkyl, such as methyl, propyl, butyl, pentyl, hexyl, heptyl, octyl, nonyl, decyl, undecyl and dodecyl), substituted alkyl group such as benzyl and phenethyl and an alkenyl group having 2 to 20 carbon atoms (e.g., unsubstituted alkenyl such as oleyl, cetyl, allyl). Examples of the aryl group include phenyl, biphenyl and naphthyl and phenyl is preferred. The position substituted onto the aryl group may be any of ortho, meta and para positions and plural groups may be substituted. B and C are each represented by the following formula:

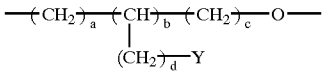

in which a, b and c are each 0, 1, 2 or 3, and d is 0 or 1, and Y is a hydrogen atom or hydroxy, provided that a, b and c are not zero at the same time; m and n are each an integer of 1 to 100; X is a hydrogen atom, an alkyl group, aralkyl group or aryl group, and examples thereof are the same as exemplified in A described above.

In formula (SII), M is a hydrogen atom, an alkali metal (e.g., Na, K, Li), an ammonium salt or an alkanolamine salt; n is an integer of 1 to 100; A is a univalent organic group, including an alkyl group having 6 to 20 carbon atoms, and preferably 6 to 12 carbon atoms (e.g., hexyl, heptyl, octyl, nonyl, decyl, undecyl, dodecyl), and an aryl group substituted by an alkyl group having 3 to 20 carbon atoms, and preferably 3 to 12 carbon atoms (e.g., propyl, butyl, pentyl, hexyl, heptyl, octyl, nonyldecyl, undecyl, dodecyl), in which the aryl group include, for example, phenyl, tolyl, xylyl, biphenyl and naphthyl and of these, phenyl and tolyl are preferred. The position of thealkyl group substituted onto the aryl group may be any of ortho, meta and para.

Exemplary examples of the compound represented by formula (SI) or (SII) are shown below but are not limited to these.

SI-1

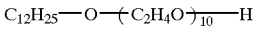

SI-2

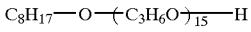

SI-3

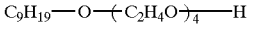

SI-4

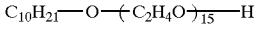

SI-5

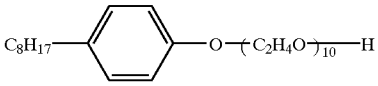

SI-6

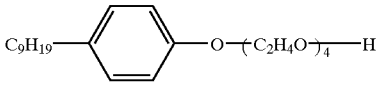

SI-7

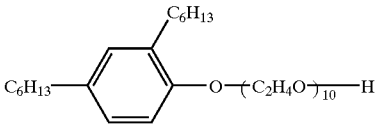

SI-8

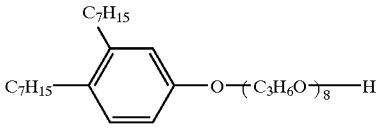

SI-9

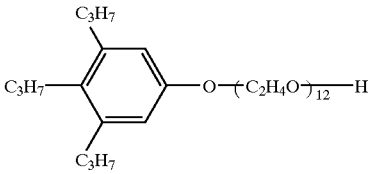

SI-10

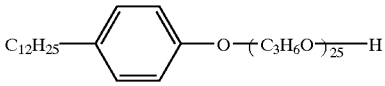

SI-11

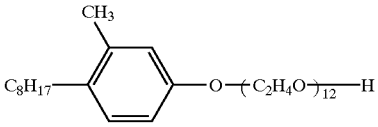

SI-12

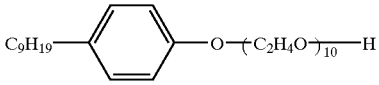

SI-13

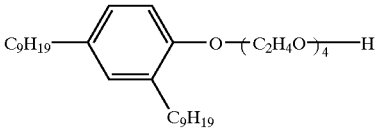

SI-14

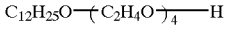

SI-15

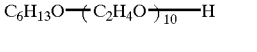

SI-16

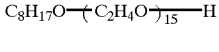

SI-17

SI-18

SI-19

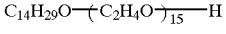

SI-20

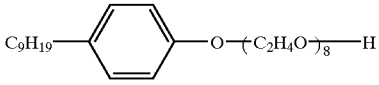

SI-21

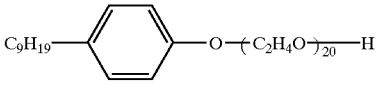

SI-22

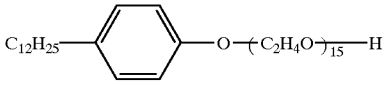

SI-23

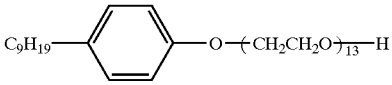

SI-24

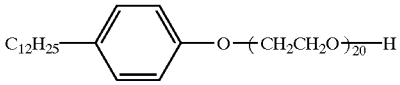

-continued
SI-25
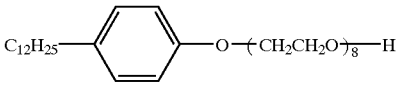
SI-26
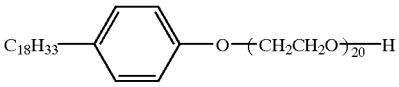
SI-27
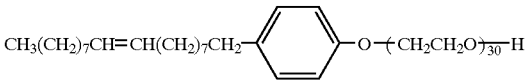
SI-28
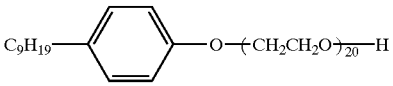
SI-29
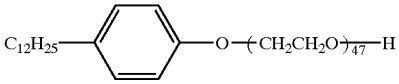
SI-30
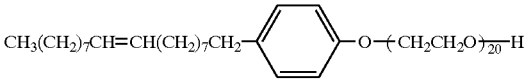
SI-31
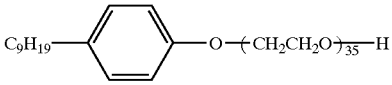
SI-32
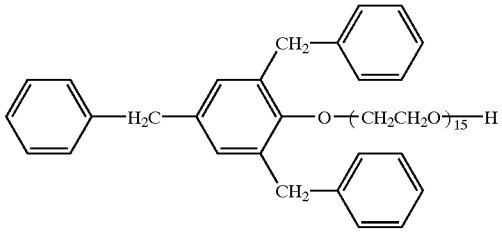
SI-33
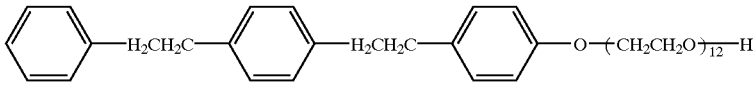
SI-34
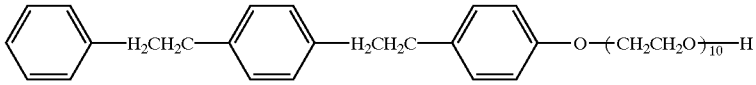
SI-35
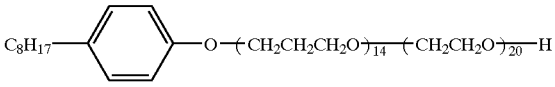
SI-36
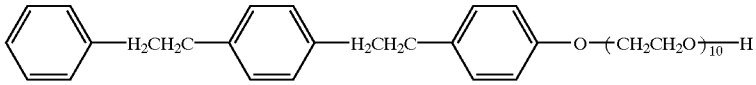
SI-37
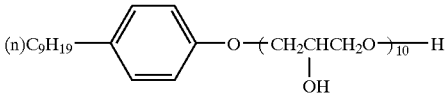
SI-38
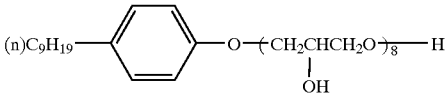
SI-39
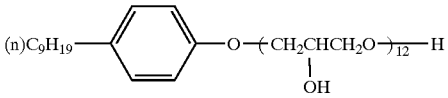
SI-40
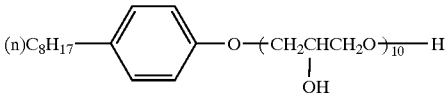
SI-41
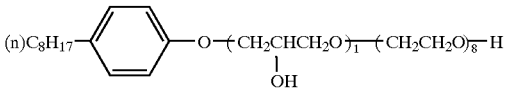
SI-42
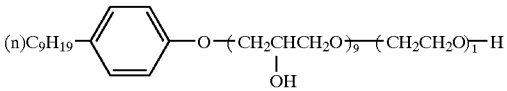
SI-43
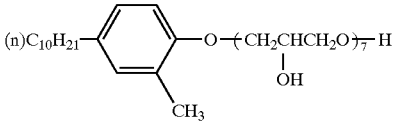
SI-44
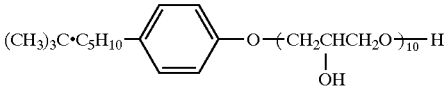
SI-45
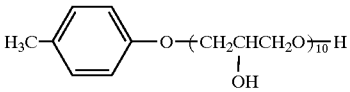
SI-46
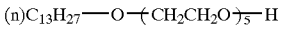
SI-47
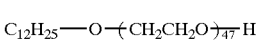
SI-48
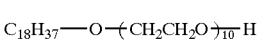
SI-49
SI-50

-continued
SI-51
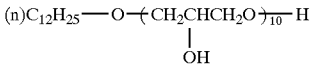
SI-52
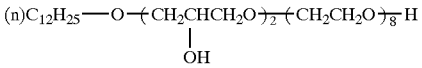
SI-53
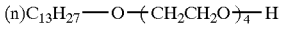
SI-54
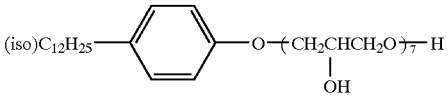
SI-55
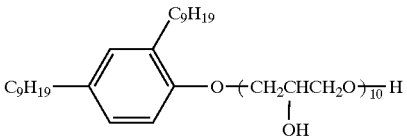
SI-56
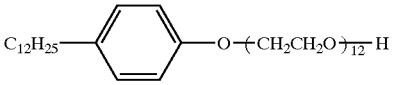
SI-57
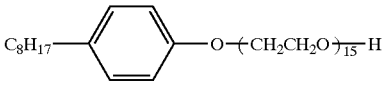
SI-58
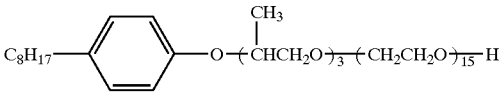
SI-59
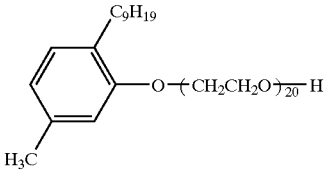
SI-60
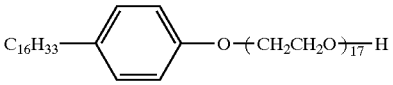
SI-61
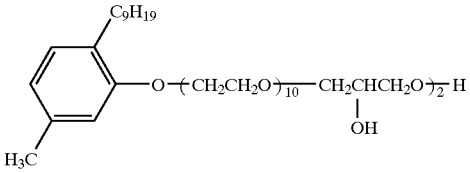
SI-62
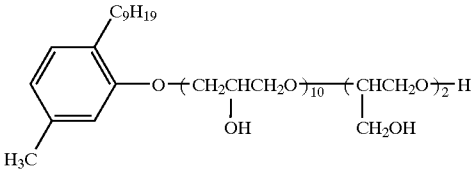
SI-63
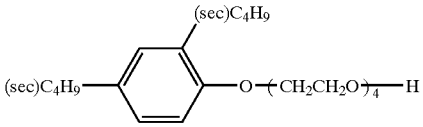
SI-64
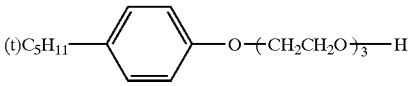
SI-65
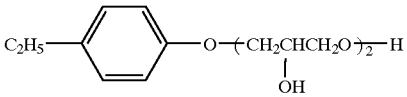
SI-66
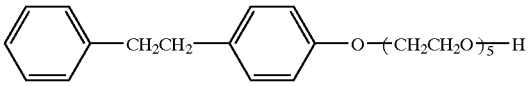
SI-67
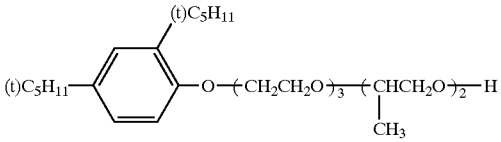
SI-68
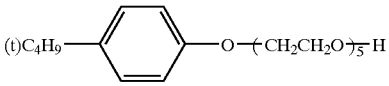
SI-69
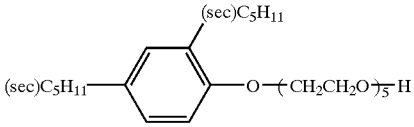
SI-70
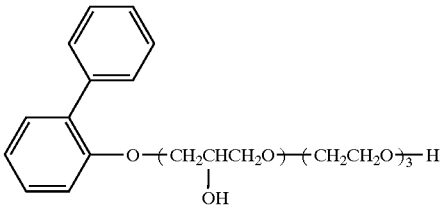
SI-71
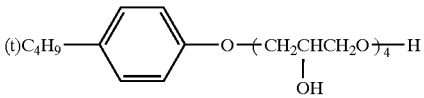
SI-72
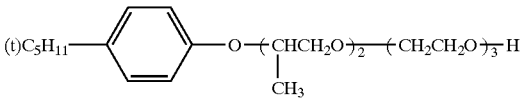

-continued

SI-73

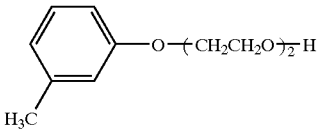

SI-74

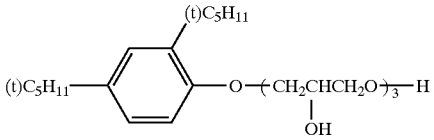

SI-75

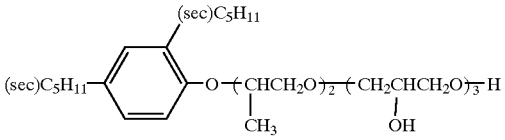

SI-76

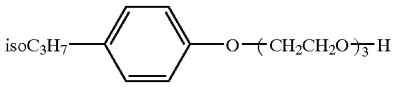

SI-77

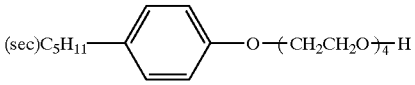

SI-78

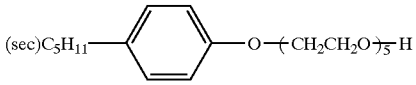

SII-1

$C_9H_{19}O(C_2H_4O)_4SO_3Na$

SII-2

$C_{10}H_{21}O(C_2H_4O)_{15}SO_3Na$

SII-3

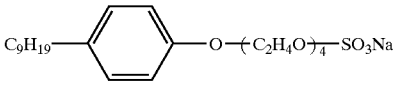

SII-4

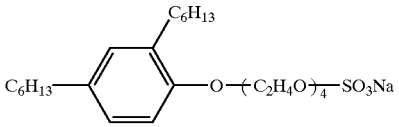

SII-5

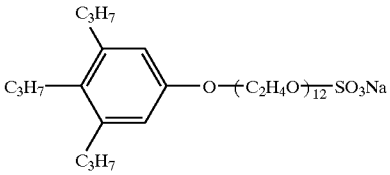

SII-6

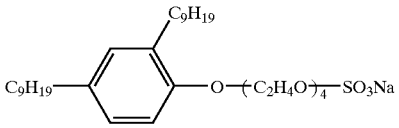

SII-7

$C_{12}H_{25}O(C_2H_4O)_4SO_3Na$ $C_{18}H_{37}O(C_2H_4O)_{23}SO_3Na$

SII-8

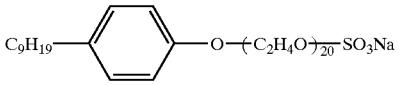

SII-9

Of the foregoing exemplified compounds preferred are SI-23, SI-28, SI-31, SI-32, SI-33, SI-34, SI-36, SI-37, SI-47, SII-8 and SII-9. The compound represented by formula (SI) or (SII) is preferably used in an amount of 0.01 to 2.0 g per liter of color developer solution, which prevents precipitation of the color developing agent and prevents staining. Furthermore, the compound (surfactant) represented by formula (SI) or (SII) is contained preferably in a concentration of ⅕ to 10 times the critical micelle concentration (CMC) of the compound in the color developer solution. The critical micelle concentration of a surfactant is a narrow concentration range, in which the surface tension of the solution is rapidly lowered, while increasing the surfactant concentration. In the presence of a hydrophobic substance, the surface tension often reaches a minimum value within such a concentration range, as in the color developing solution. In such as case, the concentration corresponding to the minimum value is referred to as the critical micelle concentration.

Color developing agents are generally low in water-solubility and unstably dispersed in the developer solution, so that they are easily oriented along the hydrophobic interface and markedly precipitate in the liquid interface or in the interface with the vessel walls. It is supposed that the surfactant orients itself along the hydrophobic interface, thereby preventing interfacial precipitation of the color developing agent. Accordingly, a concentration of a surfactant in a color developer solution being less than ⅕ times the critical micelle concentration results in lowered prevention of the interfacial precipitation of the color developing agent; on the other hand, a concentration of more than 10 times the critical micelle concentration results in most of the surfactant existing in a micelle state, lowering solubility of the color developing agent. In the invention, the use of the compounds represented by formulas (SI) and (SII) results in further enhanced effects intended in the invention. For example, precipitation shown in Example 1 was further improved to the extent of 20% by the use of the compounds.

The color developer solution preferably contains an aromatic sulfonic acid or its salt thereof. The aromatic sulfonic acid or its salt refers to a compound in which an unsaturated conjugated ring having aromaticity and attached with a sulfonic acid group or its salt (i.e., sulfonate salt thereof). The sulfonic acid group or sulfonate group may be single or plural. The ring having aromaticity may contain a heteroatom or may be substituted by any substituent group. The compound may contain plural rings having aromaticity or may be a polymer. Examples of the sulfonate salt include an alkali metal salt such as a lithium, sodium or potassium salt and ammonium salt.

The aromatic sulfonic acid or its salt used in the invention is preferably a compound represented by the following formula (I) or (J):

formula (I)

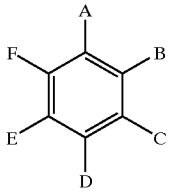

wherein at least one of A through F represents a sulfonic acid group or a sulfonate group and the remainder thereof being a hydrogen atom, a halogen atom, an alkyl group, an alkenyl group or alkynyl group;

formula (J)

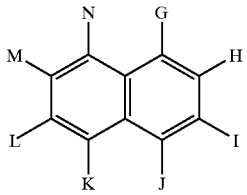

wherein at least one of G through N represents a sulfonic acid group or a sulfonate group and the remainder thereof being a hydrogen atom, a halogen atom, an alkyl group, an alkenyl group or alkynyl group. In the formula (I) or (J), the alkyl group represented by A through F or G through N preferably has 1 to 10 carbon atoms and its carbon chain may be straight or branched; the alkenyl or alkynyl group represented by A through F or G through N preferably has 2 to 10 carbon atoms and its carbon chain may be straight or branched.

Exemplary examples of the compound represented by formula (I) or (J) are shown below but are not limited to these. All of the exemplified compounds are represented by a sodium sulfonate form, but some or all of them may be a sulfonic acid or other sulfonate salt.

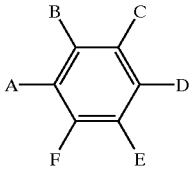

| Compound No. | A | B | C | D | E | F |
|---|---|---|---|---|---|---|
| I-1 | H | H | H | $—SO_3Na$ | H | H |
| I-2 | $—CH_3$ | H | H | $—SO_3Na$ | H | H |
| I-3 | H | $—CH_3$ | H | $—SO_3Na$ | H | H |
| I-4 | H | H | $—CH_3$ | $—SO_3Na$ | H | H |
| I-5 | $—CH_2CH_3$ | H | H | $—SO_3Na$ | H | H |
| I-6 | $—CH_2CH_2CH_3$ | H | H | $—SO_3Na$ | H | H |
| I-7 | $—CH(CH_3)CH_3$ | H | H | $—SO_3Na$ | H | H |
| I-8 | $—C(CH_3)_3$ | H | H | $—SO_3Na$ | H | H |
| I-9 | $—CH=CH_2$ | H | H | $—SO_3Na$ | H | H |
| I-10 | $—CH=CHCH_3$ | H | H | $—SO_3Na$ | H | H |
| I-11 | $—CH(CH_3)CH_2$ | H | H | $—SO_3Na$ | H | H |
| I-12 | —Cl | H | H | $—SO_3Na$ | H | H |
| I-13 | —Br | H | H | $—SO_3Na$ | H | H |
| I-14 | $—CH_3$ | H | $—CH_3$ | $—SO_3Na$ | H | H |
| I-15 | $—CH_3$ | H | H | $—CH_3$ | $—SO_3Na$ | H |
| I-16 | —Cl | H | $—CH_3$ | $—SO_3Na$ | H | H |
| I-17 | $—CH_3$ | H | —Cl | $—SO_3Na$ | H | H |
| I-18 | H | H | $—SO_3Na$ | H | $—SO_3Na$ | H |
| I-19 | $—SO_3Na$ | H | H | $—SO_3Na$ | H | H |
| I-20 | $—CH_3$ | H | $—SO_3Na$ | H | $—SO_3Na$ | H |

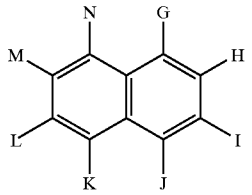

| Compound No. | G | H | I | J | K | L | M | N |
|---|---|---|---|---|---|---|---|---|
| J-1 | —$SO_3Na$ | H | H | H | H | H | H | H |
| J-2 | H | —$SO_3Na$ | H | H | H | H | H | H |
| J-3 | H | —$SO_3Na$ | H | H | H | —$CH_3$ | H | H |
| J-4 | —$SO_3Na$ | H | H | H | —$SO_3Na$ | H | H | H |
| J-5 | H | —$SO_3Na$ | H | H | H | —$SO_3Na$ | H | H |
| J-6 | H | H | —$SO_3Na$ | H | H | —$SO_3Na$ | H | H |
| J-7 | H | —$SO_3Na$ | H | —$SO_3Na$ | H | H | H | H |
| J-8 | —$SO_3Na$ | H | —$SO_3Na$ | H | H | —$SO_3Na$ | H | H |
| J-9 | —$CH_3$ | H | —$SO_3Na$ | H | H | —$SO_3Na$ | H | H |
| J-10 | —Cl | H | —$SO_3Na$ | H | H | —$SO_3Na$ | H | H |
| J-11 | H | —$SO_3Na$ | H | H | H | —$SO_3Na$ | H | —Cl |
| J-12 | H | H | —$SO_3Na$ | H | H | —Cl | H | H |

The aromatic sulfonic acid compound or its sulfonate used in the color developer solution according to the invention is contained in an amount of 10 to 200 g, and preferably 20 to 100 g per liter of developer solution. In the invention, the combined use of the compound of formula (I) and that of formula (J) results in further enhanced effects intended in the invention. For example, precipitation shown in Example 1 was further improved to the extent of 20%.

The concentrated color developer composition or color developer solution according to the invention has practicability such as providing color development to an imagewise exposed silver halide photographic element comprising a support and at least one silver halide emulsion layer containing silver halide grains which are imagewise distributed and are developable. A variety of photographic elements containing various types of emulsions (such as color negative film, color reversal film, color print paper, and color cine-film and its print) can be processed using the present invention. Such types of emulsions are commonly known in the photographic art (as described in Research Disclosure).

The present invention is useful for processing color print paper comprising high chloride silver halide emulsion (containing at least 70 mol % chloride, and preferably at least 90 mol % chloride, based on silver). Such color print payer comprises at least one layer having any silver content and in one embodiment, an element having a low silver content (i.e., less than 0.8 g/$m^2$) is processed.

Color development is conducted by bringing an imagewise exposed silver halide photographic element into contact with a color developer solution prepared according to the invention in a suitable processing apparatus under appropriate conditions of time and temperature to form in intended developed images. Thereafter, in addition to the foregoing development, conventional processing steps are carried out in a specifically desired order, including a development stopping step, bleaching step, fixing step, bleach0fixing step, washing (or rising) step, stabilizing step and drying step. There are commonly known various useful processes including process C-41 for color negative film, process RA-4 for color paper and process E-6 for color reversal film, and conditions and materials used for the processes.

The processing time and temperature for respective processing steps are those commonly known in the art. For example, color development is carried out at 20 to 60° C. The total processing time can be at most 40 min., and preferably 75 to 450 sec. In the case of process for color paper, the total processing time preferably is further shortened (e.g., 45 sec. or less). Replenisher solutions used in the invention can be prepared by diluting the concentrated color developer composition by a factor of at least 4 and at most 12, and preferably 4 to 10. Dilution can be carried out during or before processing.

Amounts of various compounds used in the invention are described as a concentration in a color developer solution. In the case of a concentrated composition, the amounts can be determined by taking into account of the dilution ratio thereof.

EXAMPLES

The present invention will be further described based on examples.

Example 1

There was prepared the following processing solution used for color paper.

| Color developer solution | |
|---|---|
| Pentasodium diethylenetriaminpentaacetate | 3.0 g/l |
| Triazinylstilbene type brightener | 1.0 g/l |
| Sodium p-toluenesulfonate | 5.0 g/l |
| Sodium sulfite | 0.4 g/l |

Compound of formula (1) in an amount shown in Table 1

Compound of formula (2) in an amount shown in Table 1

| | |
|---|---|
| Color developing agent (1) | 0.02 mol/l |
| Potassium carbonate | 35.0 g/l |
| KCl | 3.5 g/l |
| Water to make | 1 liter |

The pH was adjusted to 10.3 with sulfuric acid or KOH. The foregoing color developer tank solution of 200 ml was put into a beaker and a ⅔ portion of a rectangular vinyl chloride resin plate was immersed in the solution, and after allowed to stand at 40° C. for 3 or 7 days, stain precipitated in the vicinity of the liquid interface of the plate was visually evaluated. Replenishing water to compensate for evaporation was daily conducted. Results are shown in Table 1. In the Table, "Total Molar Concentration" refers to the total molar concentration of compound of formula (1) and compound of formula (2); and "Molar Ratio" indicated a ratio in mol. of compound of formula (1): compound of formula (2).

TABLE 1

| Experiment No. | Compound of Formula (1) | Compound of Formula (2) | Total Molar Concentration (mol/l) | Molar Ratio | Precipitation After 3 days | Precipitation After 7 days | Remark |
|---|---|---|---|---|---|---|---|
| 1-1 | 1-2 | — | 0.015 | 100:0 | D | D | Comp. |
| 1-2 | 1-2 | 2-2 | 0.015 | 2000:1 | D | D | Comp. |
| 1-3 | 1-2 | 2-2 | 0.015 | 1000:1 | B | C | Inv. |
| 1-4 | 1-2 | 2-2 | 0.015 | 500:1 | B | C | Inv. |
| 1-5 | 1-2 | 2-2 | 0.015 | 200:1 | B | C | Inv. |
| 1-6 | 1-2 | 2-2 | 0.015 | 100:1 | A | B | Inv. |
| 1-7 | 1-2 | 2-2 | 0.015 | 50:1 | A | B | Inv. |
| 1-8 | 1-2 | 2-2 | 0.015 | 20:1 | A | B | Inv. |
| 1-9 | 1-2 | 2-2 | 0.015 | 10:1 | A | B | Inv. |
| 1-10 | 1-2 | 2-2 | 0.015 | 5:1 | B | C | Inv. |
| 1-11 | 1-2 | 2-2 | 0.015 | 2:1 | B | C | Inv. |
| 1-12 | 1-2 | 2-2 | 0.015 | 1:1 | B | C | Inv. |
| 1-13 | 1-2 | 2-2 | 0.015 | 2:1 | C | D | Comp. |
| 1-14 | 1-18 | 2-18 | 0.015 | 100:0 | D | D | Comp. |
| 1-15 | 1-18 | 2-18 | 0.015 | 2000:1 | D | D | Comp. |
| 1-16 | 1-18 | 2-18 | 0.015 | 1000:1 | B | C | Inv. |
| 1-17 | 1-18 | 2-18 | 0.015 | 500:1 | B | C | Inv. |
| 1-18 | 1-18 | 2-18 | 0.015 | 200:1 | B | C | Inv. |
| 1-19 | 1-18 | 2-18 | 0.015 | 100:1 | A | B | Inv. |
| 1-20 | 1-18 | 2-18 | 0.015 | 50:1 | A | B | Inv. |
| 1-21 | 1-18 | 2-18 | 0.015 | 20:1 | A | B | Inv. |
| 1-22 | 1-18 | 2-18 | 0.015 | 10:1 | A | B | Inv. |
| 1-23 | 1-18 | 2-18 | 0.015 | 5:1 | B | C | Inv. |
| 1-24 | 1-18 | 2-18 | 0.015 | 2:1 | B | C | Inv. |
| 1-25 | 1-18 | 2-18 | 0.015 | 1:1 | B | C | Inv. |
| 1-26 | 1-18 | 2-18 | 0.015 | 2:1 | C | D | Comp. |
| 1-27 | 1-19 | — | 0.025 | 100:0 | D | D | Comp. |
| 1-28 | 1-19 | 2-19 | 0.025 | 20:1 | B | B | Inv. |
| 1-29 | 1-19 | 2-2 | 0.025 | 20:1 | A | B | Inv. |
| 1-30 | 1-19 | 2-18 | 0.025 | 20:1 | A | B | Inv. |

Evaluation was made with respect to staining due to precipitation, based on the following criteria:
A: no deposits were observed,
B: staining was slightly observed,
C: deposits were clearly observed,
D: crystals were precipitated.

As apparent from Table 1, it was shown that the combined use of the compound of formula (1) with the compound of formula (2) in a ratio within the range of 1000:1 to 1:1 led to improved results in interfacial precipitation. Specifically, the molar ratio within the range of 100:1 to 10:1 was preferred.

Example 2

Experiments were carried out similarly to Experiment No. 1-14 or 1-21 in Example 1, provided that the molar amount of color developing agent (1) was varied as shown in Table 2. Evaluation was made similarly to Example 1 and results thereof are shown in Table 2.

TABLE 2

| Experiment No. | Color Developing Agent | Addition of Compound 1-18 (Comparison) Precipitation After 3 days | Addition of Compound 1-18 (Comparison) Precipitation After 7 days | Addition of Compounds 1-18 and 2-18 (20:1) Precipitation After 3 days | Addition of Compounds 1-18 and 2-18 (20:1) Precipitation After 7 days |
|---|---|---|---|---|---|
| 2-1 | 0.015 | B | C | A | A |
| 2-2 | 0.018 | B | C | A | A |

TABLE 2-continued

| Experiment No. | Color Developing Agent | Addition of Compound 1-18 (Comparison) Precipitation After 3 days | Addition of Compound 1-18 (Comparison) Precipitation After 7 days | Addition of Compounds 1-18 and 2-18 (20:1) Precipitation After 3 days | Addition of Compounds 1-18 and 2-18 (20:1) Precipitation After 7 days |
|---|---|---|---|---|---|
| 2-3 | 0.020 | D | D | A | B |
| 2-4 | 0.025 | D | D | A | B |
| 2-5 | 0.030 | D | D | A | B |
| 2-6 | 0.035 | D | D | B | B |
| 2-7 | 0.040 | D | D | B | B |
| 2-8 | 0.045 | D | D | C | C |

As apparent from Table 2, it was shown that a concentration of the color developing agent of 0.02 to 0.04 mol/l led to further enhanced effects of the invention.

Example 3

Experiments were carried out similarly to Experiment No. 1-18, provided that diethylene glycol) denoted as DEG) or polyethylene glycol #600 (denoted as PEG#600), as a compound of formula (3) was added, as shown in Table 3. Evaluation was made similarly to Example 1 and results thereof are shown in Table 3.

TABLE 3

| Experiment No. | Compound of Formula (3) (g/l) | Precipitation After 3 days | Precipitation After 7 days |
|---|---|---|---|
| 3-1 | — | B | C |
| 3-2 | DEG (2) | B | B |
| 3-3 | DEG (5) | B | B |
| 3-4 | DEG (10) | A | A |
| 3-5 | DEG (20) | A | A |
| 3-6 | DEG (50) | A | A |
| 3-7 | DEG (100) | A | A |
| 3-8 | DEG (120) | A | B |
| 3-9 | PEG#600 (2) | B | B |
| 3-10 | PEG#600 (5) | B | B |
| 3-11 | PEG#600 (10) | A | A |
| 3-12 | PEG#600 (20) | A | A |
| 3-13 | PEG#600 (50) | A | A |
| 3-14 | PEG#600 (100) | A | A |
| 3-15 | PEG#600 (120) | B | B |

As apparent from Table 3, it was shown that addition of the compound of formula (3) resulted in remarkably enhanced effects of the invention. Specifically, it was also proved that addition of 10 to 100 g/l was preferred.

Example 4

There was prepared the following processing solution used for color paper.

| Color developer replenishing solution | |
|---|---|
| Pentasodium diethylenetriaminpentaacetate | 3.0 g/l |
| Triazinylstilbene type brightener | 2.0 g/l |
| Sodium p-toluenesulfonate | 10.0 g/l |
| Diethylene glycol | 20 g/l |
| Sodium sulfite | 1.0 g/l |
| Exemplified compounds 1-18 and 2-18 in a molar ratio shown in Table 4 and a total amount of | 0.030 mol/l |
| Color developing agent (1) | 0.030 mol/l |
| Potassium carbonate | 35.0 g/l |
| Water to make | 1 liter |

The pH was adjusted to 11.2 with sulfuric acid or KOH.

| Color developer tank solution | |
|---|---|
| Pentasodium diethylenetriaminpentaacetate | 3.0 g/l |
| Triazinylstilbene type brightener | 1.0 g/l |
| Sodium p-toluenesulfonate | 10.0 g/l |
| Diethylene glycol | 20 g/l |
| Sodium sulfite | 0.4 g/l |

-continued

| Color developer tank solution | |
|---|---|
| Exemplified compounds 1-18 and 2-18 in a molar ratio shown in Table 4 and a total amount of | 0.018 mol/l |
| Color developing agent (1) | 0.016 mol/l |
| Potassium carbonate | 35.0 g/l |
| KCl | 3.5 g/l |
| Water to make | 1 liter |

The pH was adjusted to 10.3 with sulfuric acid or KOH.

| Bleach-fixer replenishing and tank solution | |
|---|---|
| Ammonium sulfite (aqueous 40% solution) | 100 g/l |
| Ammonium thiosulfate | 120 g/l |
| Ammonium ethylenediaminetetraacetate iron salt | 75.0 g/l |
| Acetic acid | 10.0 g/l |
| Water to make | 1 liter |

The pH of the replenisher and tank solutions were respectively adjusted to 5.0 and 6.0 with sulfuric acid or ammonia water.

| Stabilizer replenishing and tank solution | |
|---|---|
| Disodium hydroxyethylidene-1,1-diphosphonate | 4.0 g/l |
| Pentasodium diethylenetriaminpentaacetate | 2.0 g/l |
| Sodium sulfite | 1.0 g/l |
| Brightener Chino-pearl (available from Chiba Specialities) | 1.0 g/l |
| Water to make | 1 liter |

The pH was adjusted to 7.0 with sulfuric acid or ammonia water.

Exposed color paper (Konica Color QA Paper Type A7) was subjected to running process in accordance with the following conditions.

| Step | Tank Volume (liter) | Temperature (° C.) | Time (sec) | Repl. Rate* ($ml/m^2$) |
|---|---|---|---|---|
| Color developing | 12.5 | 40.2 ± 0.3 | 22 | 80 |
| Bleach-fixing | 12.3 | 37 ± 2 | 22 | 80 |
| Stabilizing 1 | 11.8 | 35 ± 3 | 22 | Cascade flow |
| Stabilizing 2 | 12.0 | 35 ± 3 | 22 | Cascade flow |
| Stabilizing 3 | 12.5 | 35 ± 3 | 22 | 200 |
| Drying | | 70 to 85 | 30 | |

*Replenishing rate

In the running process, color paper was processed in an amount of 10 $m^2$ per day and continued until the total replenishing amount of the color developer solution reached the tank volume (i.e., one round).

Evaluation was visually made at the finish of the running process with respect to precipitation in the vicinity of the interface of the color developer solution and on a transport rack in contact with the solution (i.e., precipitation in tank/rack), and deposit of stain onto color paper (i.e., paper stain). Results thereof are shown in Table 4.

TABLE 4

| Experiment No. | Compound of Formula (1) | Compound of Formula (2) | Molar Ratio | Precipitation in Tank/Rack | Paper Stain | Remark |
|---|---|---|---|---|---|---|
| 4-1 | 1-18 | — | 100:0 | D | C | Comp. |
| 4-2 | 1-18 | 2-18 | 2000:1 | D | C | Comp. |
| 4-3 | 1-18 | 2-18 | 1000:1 | B | B | Inv. |
| 4-4 | 1-18 | 2-18 | 500:1 | B | B | Inv. |
| 4-5 | 1-18 | 2-18 | 200:1 | B | B | Inv. |
| 4-6 | 1-18 | 2-18 | 100:1 | A | A | Inv. |
| 4-7 | 1-18 | 2-18 | 50:1 | A | A | Inv. |
| 4-8 | 1-18 | 2-18 | 20:1 | A | A | Inv. |
| 4-9 | 1-18 | 2-18 | 10:1 | A | A | Inv. |
| 4-10 | 1-18 | 2-18 | 5:1 | B | B | Inv. |
| 4-11 | 1-18 | 2-18 | 2:1 | B | B | Inv. |
| 4-12 | 1-18 | 2-18 | 1:1 | B | B | Inv. |
| 4-13 | 1-18 | 2-18 | 2:1 | C | C | Comp. |

Precipitation in tank/rack was evaluated based on the following criteria:
A: no precipitate was observed,
B: staining was slightly observed,
C: deposits were clearly observed,
D: crystals were precipitated.

Paper stain was also evaluated based on the following criteria:

A: no staining was observed,

B: slightly staining was observed to an extent of one sheet among 100 sheets,

C: slightly staining was observed to an extent of one sheet among 10 sheets,

D: staining was observed in almost prints.

As apparent from Table 4, even when subjected to running process in an automatic processor, the combined use of a compound of formula (1) and a compound of formula (2) in a molar ratio falling within the range of 1000:1 to 1:1 led to improved results in interfacial precipitation as well as staining in printed paper. The molar ratio within the range of 100:1 to 10:1 was specifically preferred.

Example 5

Experiments were carried out similarly to Experiment No. 4-1 and 4-8 in Example 4, provided that the replenishing rate of the color developer solution was varied as shown in Table 5. The content of a color developing agent in the color developer replenishing solution was adjusted so that the content of the color developing agent was 0.016 mol/l. Evaluation was made similarly. Results thereof are shown in Table 5.

TABLE 5

| | | Addition of Compound 1-18 (Comparison) | | Addition of Compounds 1-18 and 2-18 (20:1) | |
|---|---|---|---|---|---|
| Experiment No. | Replenishing Rate (ml/m$^2$) | Precipitation in Tank/Rack | Paper Stain | Precipitation in Tank/Rack | Paper Stain |
| 5-1 | 10 | D | D | C | C |
| 5-2 | 20 | D | C | B | A |
| 5-3 | 30 | D | C | B | A |
| 5-4 | 50 | D | C | A | A |
| 5-5 | 80 | D | C | A | A |
| 5-6 | 100 | D | C | A | A |
| 5-7 | 120 | C | B | A | A |

As apparent from Table 5, it was proved that the color developer replenishing rate of 20 to 100 ml/m$^2$ resulted in further enhanced effects of the invention.

Example 6

There was prepared the following processing solution used for color paper.

| Concentrated color developer solution | |
|---|---|
| Triethanolamine | 100 g/l |

Compound of formula (1) in an amount shown in Table 6

Compound of formula (2) in an amount shown in Table 6

| | |
|---|---|
| Color developing agent (17) | 0.10 mol/l |
| Triazinylstilbene type brightener | 7 g/l |
| Tetrasodium 1-hydroxyethylidene-1,1-diphosphonate | 7 g/l |
| Lithium chloride | 10 g/l |
| Potassium carbonate | 200 g/l |
| KCl | 3.5 g/l |
| Water to make | 1 liter |

The pH was adjusted to 12.5 with KOH.

The foregoing concentrated color developer solution of 200 ml was sealed in a polyethylene bottle and aged at 5° C. After one day or three days, the presence/absence of precipitate was observed. Results are shown in Table 6.

TABLE 6

| Experiment No. | Compound of Formula (1) | Compound of Formula (2) | Total Molar Concentration (mol/l) | Molar Ratio | Precipitation After 1 day | Precipitation After 3 days | Remark |
|---|---|---|---|---|---|---|---|
| 6-1 | 1-2 | — | 0.015 | 100:0 | C | C | Comp. |
| 6-2 | 1-2 | 2-2 | 0.015 | 2000:1 | C | C | Comp. |
| 6-3 | 1-2 | 2-2 | 0.015 | 1000:1 | A | B | Inv. |
| 6-4 | 1-2 | 2-2 | 0.015 | 500:1 | A | B | Inv. |
| 6-5 | 1-2 | 2-2 | 0.015 | 200:1 | A | B | Inv. |
| 6-6 | 1-2 | 2-2 | 0.015 | 100:1 | A | A | Inv. |
| 6-7 | 1-2 | 2-2 | 0.015 | 50:1 | A | A | Inv. |
| 6-8 | 1-2 | 2-2 | 0.015 | 20:1 | A | A | Inv. |
| 6-9 | 1-2 | 2-2 | 0.015 | 10:1 | A | A | Inv. |
| 6-10 | 1-2 | 2-2 | 0.015 | 5:1 | A | B | Inv. |
| 6-11 | 1-2 | 2-2 | 0.015 | 2:1 | A | B | Inv. |
| 6-12 | 1-2 | 2-2 | 0.015 | 1:1 | A | B | Inv. |

TABLE 6-continued

| Experiment No. | Compound of Formula (1) | Compound of Formula (2) | Total Molar Concentration (mol/l) | Molar Ratio | Precipitation After 1 day | Precipitation After 3 days | Remark |
|---|---|---|---|---|---|---|---|
| 6-13 | 1-2 | 2-2 | 0.015 | 2:1 | B | C | Comp. |
| 6-14 | 1-18 | 2-18 | 0.015 | 100:0 | C | C | Comp. |
| 6-15 | 1-18 | 2-18 | 0.015 | 2000:1 | C | C | Comp. |
| 6-16 | 1-18 | 2-18 | 0.015 | 1000:1 | A | B | Inv. |
| 6-17 | 1-18 | 2-18 | 0.015 | 500:1 | A | B | Inv. |
| 6-18 | 1-18 | 2-18 | 0.015 | 200:1 | A | B | Inv. |
| 6-19 | 1-18 | 2-18 | 0.015 | 100:1 | A | A | Inv. |
| 6-20 | 1-18 | 2-18 | 0.015 | 50:1 | A | A | Inv. |
| 6-21 | 1-18 | 2-18 | 0.015 | 20:1 | A | A | Inv. |
| 6-22 | 1-18 | 2-18 | 0.015 | 10:1 | A | A | Inv. |
| 6-23 | 1-18 | 2-18 | 0.015 | 5:1 | A | B | Inv. |
| 6-24 | 1-18 | 2-18 | 0.015 | 2:1 | A | B | Inv. |
| 6-25 | 1-18 | 2-18 | 0.015 | 1:1 | A | B | Inv. |
| 6-26 | 1-18 | 2-18 | 0.015 | 2:1 | B | C | Comp. |
| 6-27 | 1-19 | — | 0.020 | 100:0 | C | C | Comp. |
| 6-28 | 1-19 | 2-19 | 0.020 | 20:1 | A | A | Inv. |
| 6-29 | 1-19 | 2-2 | 0.020 | 20:1 | A | A | Inv. |
| 6-30 | 1-19 | 2-18 | 0.020 | 20:1 | A | A | Inv. |

Precipitation was evaluated based on the following criteria:
A: no deposits were observed,
B: slight deposits were observed,
C: precipitates were markedly observed.

As apparent from Table 6, it was shown that the combined use of the compound of formula (1) with the compound of formula (2) in a ratio within the range of 1000:1 to 1:1 led to improved results in precipitation at a relatively low temperature. Specifically, the molar ratio within the range of 100:1 to 10:1 was preferred.

Example 7

There was prepared the following processing solution used for color paper.

| Concentrated color developer solution | |
|---|---|
| Triethanolamine | 30 g/l |

Compound of formula (3) in an amount shown in Table 7

| | |
|---|---|
| Exemplified compound 1-18 | 0.19 mol/l |
| Exemplified compound 2-18 | 0.01 mol/l |
| Color developing agent (17) | 0.15 mol/l |
| Triazinylstilbene type brightener | 10 g/l |
| Tetrasodium 1-hydroxyethylidene-1,1-diphosphonate | 10 g/l |
| Lithium chloride | 15 g/l |
| Potassium carbonate | 300 g/l |
| KCl | 5 g/l |
| Water to make | 1 liter |

The pH was adjusted to 12.5 with KOH.

The foregoing concentrated color developer solution was evaluated similarly to Example 6. Results thereof are shown in Table 7.

TABLE 7

| Experiment No. | Compound of Formula (3) (g/l) | Precipitation After 1 day | Precipitation After 3 days |
|---|---|---|---|
| 7-1 | — | B | C |
| 7-2 | DEG* (10) | A | B |
| 7-3 | DEG (30) | A | B |
| 7-4 | DEG (50) | A | A |
| 7-5 | DEG (100) | A | A |
| 7-6 | DEG (500) | A | A |
| 7-7 | DEG (700) | A | A |
| 7-8 | DEG (800) | A | B |
| 7-9 | DPG* (10) | A | B |
| 7-10 | DPG (30) | A | B |
| 7-11 | DPG (50) | A | A |
| 7-12 | DPG (100) | A | A |
| 7-13 | DPG (300) | A | A |
| 7-14 | DPG (700) | A | A |
| 7-15 | DPG (800) | A | B |

*DEG: diethylene glycol, DPG: dipropylene glycol

As can be seen from Table 7, it was proved that the addition of the compound of formula (3) resulted in improvements in precipitation at a low temperature, even when a concentration rate of the concentration solution was increased. It was also proved that the amount of the compound of formula (3) is preferably 50 to 700 g/l.

Example 8

Experiments were carried out similarly to Experiment No. 7-6 in Example 7, provided that the pH of the concentrated solution was varied with sulfuric acid or KOH, as shown in Table 8. Evaluation was made similarly to Example 6. Results are shown in Table 8.

TABLE 8

| Experiment No. | pH | Addition of Compound 1-18 (Comparison) Precipitation | | Addition of Compounds 1-18 and 2-18 (20:1) Precipitation | |
|---|---|---|---|---|---|
| | | After 1 day | After 3 days | After 1 days | After 3 days |
| 8-1 | 10.0 | C | C | B | B |
| 8-2 | 10.5 | C | C | B | B |
| 8-3 | 11.0 | C | C | A | A |
| 8-4 | 12.0 | C | C | A | A |
| 8-5 | 13.0 | C | C | A | A |
| 8-6 | 14.0 | C | C | A | A |
| 8-7 | 14.5 | B | B | A | B |

As apparent from Table 8, it was proved that the concentrated solution pH of 11 to 14 resulted in further enhanced effects of the invention.

Example 9

Processing solutions used for color paper were prepared as shown below.

Color Developer Replenishing Solution

A concentrated color developer solution used in Experiment No. 7-6 in Example 7 was diluted by a factor of 10 to prepare a color developer replenishing solution.

| Color developer tank solution | |
|---|---|
| Triethanolamine | 30 g/l |
| Diethylene glycol | 50 g/l |
| Exemplified compound 1-18 | 0.010 mol/l |
| Exemplified compound 2-18 | 0.0005 mol/l |
| Color developing agent (1) | 0.010 mol/l |
| Triazinylstilbene type brightener | 1 g/l |
| Tetrasodium 1-hydroxyethylidene-1,1-diphosphonate | 1 g/l |
| Lithium chloride | 1.5 g/l |
| Potassium carbonate | 30 g/l |
| KCl | 3.5 g/l |
| Water to make | 1 liter |

The pH was adjusted to 10.3 with sulfuric acid or KOH.

Bleach-fixer Replenishing and Tank Solution

The solution used in Example 4 was used.

Stabilizer Replenishing and Tank Solution

The solution used in Example 4 was used.

Exposed color paper (Konica Color QA Paper Type A7) was subjected to running process in accordance with the following conditions.

| Step | Tank Volume (liter) | Temperature (° C.) | Time (sec) | Repl. Rate* ($ml/m^2$) |
|---|---|---|---|---|
| Color developing | 12.5 | 40.2 ± 0.3 | 45 | 100 |
| Bleach-fixing | 12.3 | 37 ± 2 | 45 | 80 |
| Stabilizing 1 | 11.8 | 35 ± 3 | 45 | Cascade flow |
| Stabilizing 2 | 12.0 | 35 ± 3 | 45 | Cascade flow |
| Stabilizing 3 | 12.5 | 35 ± 3 | 45 | 200 |
| Drying | | 70 to 85 | 45 | |

*Replenishing rate

In the running process, color paper was processed in an amount of 10 $m^2$ per day and continued until the total replenishing amount of the color developer solution reached the tank volume (i.e., one round). Similarly to Example 4, evaluation was visually made at the finish of the running process with respect to precipitation in the vicinity of the interface of the color developer solution and on a transport rack in contact with the solution, and deposit of stain onto color paper. Similar results were obtained.

Example 10

There was prepared the following processing solution used for color negative film.

| Concentrated color developer solution | |
|---|---|
| Diethylene glycol | 300 g/l |
| Exemplified compound 1-18 | 0.19 mol/l |
| Exemplified compound 2-18 | 0.01 mol/l |
| Color developing agent (18) | 0.15 mol/l |
| Sodium sulfite | 60 g/l |
| Diethylenetriaminepentaacetic acid | 70 g/l |
| Potassium bromide | 10 g/l |
| Potassium carbonate | 350 g/l |
| Water to make | 1 liter |

The pH was adjusted to 12.5 with KOH.

Similarly to Example 6, the foregoing concentrated color developer solution was evaluated with respect to aging stability at a low temperature. Even after 3 days, no precipitation was observed and superior results were obtained.

What is claimed is:

1. A color developer solution comprising at least a first compound represented by the following formula (1) and at least a second compound represented by the following formula (2), the first compound is contained in an amount of 0.005 to 0.05 mol per liter of the color developer solution and a molar ratio of the first compound to the second compound is between 100:1 and 10:1, $$HO—N—(X—A)_2 \qquad \text{formula (1)}$$

wherein X is an alkylene group; A is a carboxyl group, a sulfo group, phosphono group, hydroxyl group, alkoxy group, amino group, ammonia group, sulfamoyl group, or alkylsulfonyl group;

$$HO—NH—Y—B \qquad \text{formula (2)}$$

wherein Y is an alkylene group; B is a carboxyl group, sulfo group, phosphono group, hydroxyl group, alkoxy group, amino group, ammonio group, sulfamoyl group, or alkylsulfonyl group.

2. This color developer solution of claim 1, wherein the color developer solution contains 0.02 to 0.04 mol/l of a p-phenylenediamine type color developing agent.

3. The color developer solution of claim 1, wherein the color developer solution contains a compound represented by the following formula (3):

$$HO—(R—O)_n—H \qquad \text{formula (3)}$$

wherein R is $—CH_2CH_2—$, $—CH_2CH_2CH_2—$ or $CH_2CH(CH_3)—$; and n is an integer of 1 through 30.

4. The color developer solution of claim 3, wherein the color developer solution contains 10 to 100 g/l of the compound represented by formula (3).

5. The color developer solution of claim 1, wherein the developer solution contains a compound represented by the following formula (A):

formula (A)

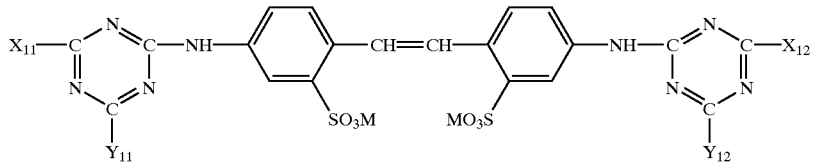

wherein $X_{11}$, $X_{12}$, $Y_{11}$ and $Y_{12}$ are independently hydroxyl, a halogen atom, morpholino grout, alkoxy group, aryloxy group, alkyl group, aryl group, amino group, alkylamino group, or arylamino group; M is hydrogen, sodium, potassium, ammonium or lithium.

6. The color developer solution of claim 1, wherein the developer solution contains a compound represented by the following formulas (B) through (H):

formula (B)

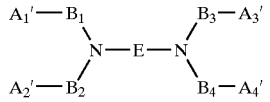

wherein E is an alkylene group, cycloalkylene group, phenylene group, —$B_5$—O—$B_5$—, —$B_5$—O—$B_5$—O—$B_5$—, or —$B_5$—Z—$B_5$—, in which Z is represented by the formula:

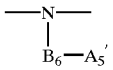

and $B_1$, $B_2$, $B_3$, $B_4$, $B_5$ and $B_6$ are each an alkylene group; $A_1'$, $A_2'$ and $A_3'$ are each —COOM' or —$PO_3(M')_2$, and $A_4'$ and $A_5'$ are each a hydrogen atom, hydroxyl, —COOM' or —$PO_3(M')_2$, in which M' is a hydrogen atom or an alkali metal atom;

formula (C)

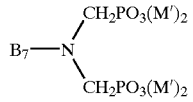

wherein $B_7$ is an alkyl group, aryl group or 6-membered nitrogen-containing heterocyclic group; and M' is a hydrogen atom or alkali metal atom;

formula (D)

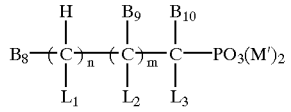

wherein $B_8$, $B_9$ and $B_{10}$ are each a hydrogen atom, hydroxyl, —COOM', —$PO_3(M')_2$ or alkyl group; $L_1$, $L_2$ and $L_3$ are each a hydrogen atom, hydroxyl, —COOM', —$PO_3(M')_2$ or —$N(J)_2$, in which J is a hydrogen atom, alkyl group, —$C_3H_4OH$ or —$PO_3(M')_2$ and M' is a hydrogen atom or alkali metal atom; m and n are each 0 or 1;

formula (E)

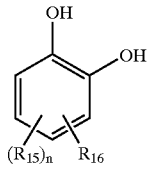

formula (F)

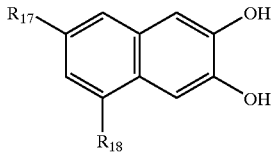

wherein $R_{15}$, $R_{16}$, $R_{17}$ and $R_{18}$ are each a hydrogen atom, halogen atom, sulfo group, substituted or unsubstituted alkyl group having 1 to 7 carbon atoms, —$OR_{19}$, —$COOR_{20}$, —$CON(R_{21})(R_{22})$ or substituted or unsubstituted phenyl group, in which $R_{19}$, $R_{20}$, $R_{21}$ and $R_{22}$ are a hydrogen atom or alkyl group having 1 to 18 carbon atoms; n is an integer of 1 to 3;

formula (G)

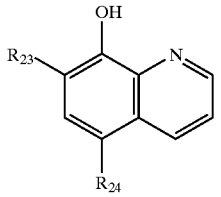

wherein $R_{23}$ and $R_{24}$ are each a hydrogen atom, halogen atom or sulfo group;

formula (H)

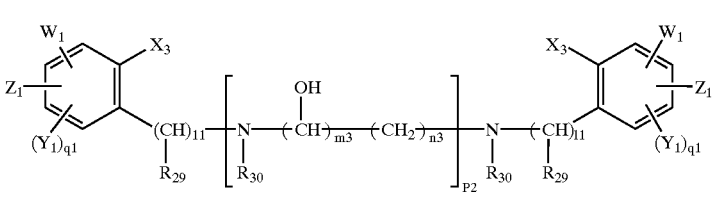

wherein $R_{29}$ and $R_{30}$ are each a hydrogen atom, a phosphoric acid group, a carboxylic acid group, —$CH_2COOH$ or —$CH_2PO_3H_2$; $X_3$ is hydroxyl group; $W_1$, $Z_1$ and $Y_1$ are each a hydrogen atom, a halogen atom, hydroxyl, cyano, a carboxylic acid group, a phosphoric acid group, sulfo group, an alkoxy group or an alkyl group; m3 is 0 or 1; n3 is an integer of 1 to 4; l1 is 1 or 2; p2 is an integer of 0 to 3; and q1 is an integer of 0 to 2.

7. The color developer solution of claim 1, wherein the developer solution contains a compound represented by the following formula (SI) or (SII):

formula (SI)

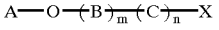

wherein A is a univalent organic group; B and C are each a group represented by the following formula:

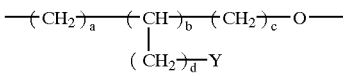

wherein a, b and c are each 0, 1, 2 or 3, d is 0 or 1, and Y is a hydrogen atom or hydroxyl, provided that a, b and c are not zero at the same time; m and n are each an integer of 1 to 100 and X is a hydrogen atom, alkyl group, aralkyl group or aryl group;

formula (SII)

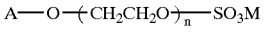

wherein A is a univalent organic group; M is a hydrogen atom, alkali metal atom, ammonium or an alkanolamine salt; n is an integer of 1 to 100.

8. The color developer solution of claim 1, wherein the developer solution contains a compound represented by the following formula (I) or (J):

formula (I)

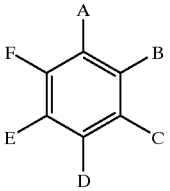

wherein at least one of A through F represents a sulfonic acid group or a sulfonate group, and the remainder thereof being a hydrogen atom, halogen atom, alkyl group, alkenyl group or alkynyl group;

formula (J)

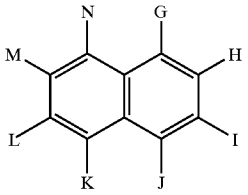

wherein at least one of G through N represents a sulfonic acid group or a sulfonate group, and the remainder thereof being a hydrogen atom, halogen atom, alkyl group, alkenyl group or alkynyl group.

9. A concentrated color developer composition comprising a p-phenylene type color developing agent, wherein the composition comprises at least a first compound represented by the following formula (1) and at least a second compound represented by the following formula (2), the first compound is contained in an amount of 0.01 to 0.5 mol per liter of the color developer composition and a molar ratio of the first compound to the second compound is between 100:1 and 10:1,

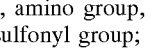

formula (1)

wherein X is an alkylene group; A is a carboxyl group, a sulfo group, phosphono group, hydroxyl group, alkoxy group, amino group, ammonio group, sulfamoyl group, or alkylsulfonyl group;

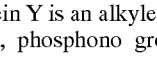

formula (2)

wherein Y is an alkylene group; B is a carboxyl group, sulfo group, phosphono group, hydroxyl group, alkoxy group, amino group, ammonio group, sulfamoyl group, or alkylsulfonyl group.

10. The concentrated composition of claim 9, wherein the color developer solution contains a compound represented by the following formula (3):

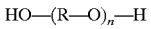

wherein R is —$CH_2CH_2$—, —$CH_2CH_2CH_2$— or $CH_2CH(CH_3)$—; and n is an integer of 1 through 30.

11. The concentrated composition of claim 10, wherein the concentrated composition contains 50 to 700 g/l of the compound represented by formula (3).

12. The concentrated composition of claim 9, wherein the concentrated composition exhibits a pH of 11 to 14.

13. A method for processing a silver halide color photographic material using an automatic processor comprising:

(a) exposing the photographic material to light and (b) developing the exposed photographic material in a tank containing a color developer solution as claimed in claim 1, wherein the color developer solution is replenished at a rate of 20 to 100 ml per $m^2$ of photographic material.

* * * * *